US006800431B2

(12) United States Patent
Miura et al.

(10) Patent No.: US 6,800,431 B2
(45) Date of Patent: Oct. 5, 2004

(54) PHOTOTHERMOGRAPHIC MATERIAL

(75) Inventors: Norio Miura, Sagamihara (JP); Ryohei Iwamoto, Hachioji (JP); Kazuaki Nakamura, Tokyo (JP); Hiroyuki Yasukawa, Hachioji (JP); Kiyoshi Fukusaka, Fussa (JP)

(73) Assignee: Konica Corporation (JP)

( * ) Notice: Subject to any disclaimer, the term of this patent is extended or adjusted under 35 U.S.C. 154(b) by 22 days.

(21) Appl. No.: 10/413,907

(22) Filed: Apr. 15, 2003

(65) Prior Publication Data

US 2003/0219686 A1 Nov. 27, 2003

(30) Foreign Application Priority Data

Apr. 23, 2002 (JP) ..... 2002-120842

(51) Int. Cl.[7] ..... G03C 1/498

(52) U.S. Cl. ..... 430/619; 430/264; 430/598

(58) Field of Search ..... 430/619, 485, 430/264, 598

(56) References Cited

U.S. PATENT DOCUMENTS 5,212,055 A 5/1993 Morigaki et al.
6,090,538 A 7/2000 Arai et al.

*Primary Examiner*—Thorl Chea
(74) *Attorney, Agent, or Firm*—Muserlian, Lucas and Mercanti

(57) ABSTRACT

There is disclosed photothermographic material exhibiting superior photographic performance and having improved latitude for variation in thermal developing conditions, comprising on a support an organic silver salt, light-sensitive silver halide and a reducing agent for silver ions, wherein the reducing agent is represented by the following formula in which $R_1$ through $R_4$, $L_1$, $X_1$, $X_2$ n and m have the meaning stated in the specification.

13 Claims, No Drawings

PHOTOTHERMOGRAPHIC MATERIAL

FIELD OF THE INVENTION

The present invention relates to a photothermographic material and an image recording method by use thereof.

PRIOR ART

In the field of graphic arts and medical treatment, there have been concerns in processing of photographic film with respect to effluents produced from wet-processing of image forming materials, and recently, reduction of the processing effluent is strongly demanded in terms of environmental protection and space saving. There is known a technique, as described in U.S. Pat. Nos. 3,152,904 and 3,487,075, and D. Morgan, "Dry Silver Photographic Materials" (Handbook of Imaging Materials, Marcel Dekker, Inc. page 48, 1991). Photographic material used in such a technique is developed at a temperature of 80° C. or higher, which is called photothermographic material.

The photothermographic material contains relatively large amounts of chemical substances so that the thickness of a light-sensitive layer or light-insensitive layer tends to increase. As a result, a loner time is required in the stage of coating or drying in the manufacture of the photothermographic material, lowering productivity.

As is known in the photographic art, reducing silver coverage is effective in reducing the layer thickness. However, simply reducing the silver coverage results in unfavorably reduced image density. To allow the image density not to be reduced, it is effective to increase the number of developing initiating points per unit area, increasing covering power. In conventional photographic materials used in graphic arts, so-called infectious development by using nucleating agents is employed to increase covering power, whereby relatively high image densities can be achieved even at a low silver coverage. For example, JP-A Nos. 10-512061 and 11-511571 disclosed such a technique (hereinafter, the term, JP-A refers to unexamined Japanese Patent Application Publication). However, it was proved that photothermographic materials containing commonly known nucleating agents are inferior in storage stability and often form yellowish silver images. Such images adversely affect diagnosis specifically for used medical check and are not suitable. There was also a defect that slight change in thermal development temperature or time easily caused appreciable variation in image density.

SUMMARY OF THE INVENTION

The present invention has been achieved in view of the foregoing problems. Thus, it is an object of the present invention to provide a photothermographic material exhibiting superior storage stability, an enhanced maximum density, reduced fogging and improved silver image tone, and having improved latitude for variation in thermal developing conditions; and an image recording method by the use thereof.

The foregoing object can be accomplished by the following constitution:

1. A photothermographic material comprising on a support an organic silver salt, light-sensitive silver halide and a reducing agent for silver ions, wherein the reducing agent is a compound represented by the following formula (1):

formula (1)

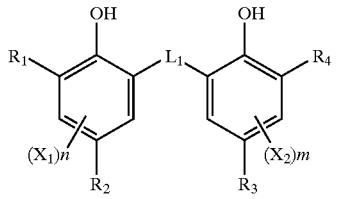

wherein $R_1$ through $R_4$ are each independently an alkyl group, at least one of $R_1$ through $R_4$ is an alkyl group containing a hydroxy group or a group capable of forming a hydroxy group upon deprotection; $L_1$ is —S— or —$CR_{55}$($R_{66}$)—, in which $R_{55}$ and $R_{66}$ are each a hydrogen atom, an alkyl group, a 3- to 10-membered non-aromatic ring group, an aryl group or a heteroaryl group; $X_1$ and $X_2$ are each a group capable of being substituted on a benzene ring; and n and m are each an integer of 0 to 2;

2. The photothermographic material as described in 1 or 2, wherein the reducing agent represented by formula (1) is represented by the following formula (2):

formula (2)

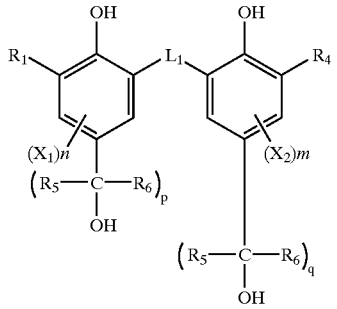

wherein $R_1$, $R_4$, $L_1$, $X_1$, $X_2$, n and m are each the same as defined in formula (1); $R_5$ and $R_6$ are a hydrogen atom or an alkyl group; p and q are each an integer of 0 to 5;

3. The photothermographic material as described in 1 or 2, wherein the photothermographic material comprises a silver-saving agent;
4. The photothermographic material as described in any of 1 through 7, wherein the silver-saving agent is represented by the following formula (X):

formula (X)

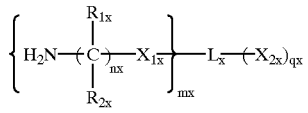

wherein $R_{1x}$ and $R_{2x}$ are each a hydrogen atom or a substituent; $X_{1x}$ is —S—, —O— or —N($R_{3x}$)—, in which $R_{3x}$ is a hydrogen atom or substituent; nx is 2 or 3; mx is an integer of 1 to 3; $X_{2x}$ is a ballast group, an adsorption group onto silver halide or a silyl group; qx is an integer of 1 to 3; and Lx is a di- to hexa-valent linkage group;

5. An image recording method, wherein a photothermographic material as described above is exposed using a laser light scanning exposure apparatus having an oscillation wavelength of 600 to 1200 nm; and
6. The image recording method as described above, wherein the scanning laser light is longitudinally multiple.

DETAILED DESCRIPTION OF THE INVENTION

One feature of the photothermographic material relating to this invention is that the reducing agent for silver ions is a specific bisphenol derivative, which is used alone or in combination with other reducing agents differing in chemical structure. Such constitution has unexpectedly inhibited deteriorations in performance during storage, such as fogging and deterioration in thermally developed silver image tone during storage.

Further, when used in combination with a silver-saving agent, there were achieved surprising effects such as enhanced maximum density, superior silver image tone and superior images resistant to variation in process. Specifically, the use of the silver-saving agent represented by the formula (X) described later has resulted in markedly advantageous effects.

The reducing agents usable in this invention are preferably bisphenol derivatives represented by the formula (1) or (2) described earlier.

The compound represented by formula (1) will be detailed. In formula (1), $R_1$ through $R_4$ independently represent an alkyl group and examples thereof include an alkyl group having 1 to 15 carbon atoms (e.g., methyl, ethyl, propyl, isopropyl, tert-butyl, pentyl, hexyl, decyl, dodecyl, pentadecyl), a halogenated alkyl group (e.g., trifluoromethyl, perfluorooctyl), and a cycloalkyl group (e.g., cyclopentyl, cyclohexyl, 1-methylcyclohexyl).

The foregoing groups may further be substituted. Examples of substituent groups include an alkyl group having 1 to 15 carbon atoms (e.g., methyl, ethyl, propyl, isopropyl, tert-butyl, pentyl, hexyl, decyl, dodecyl, pentadecyl), halogenated alkyl group (e.g., trifluoromethyl, perfluorooctyl), cycloalkyl group (e.g., cyclohexyl, cycloheptyl), alkynyl group (e.g., propargyl), glycidyl group, acrylate group, methacrylate group, aryl group, heterocyclic group (e.g., pyridyl, thiazolyl, oxazolyl, imidazolyl, furyl, pyrrolyl, pyrazinyl, pyrimidinyl, pyridazinyl, selenazolyl, sulforanyl, piperidinyl, pyrazolyl, tetrazolyl), alkoxy group (e.g., methoxy, ethoxy, propoxy, pentyloxy, cyclopentyloxy, hexyloxy, cyclohexyloxy) aryloxy group (e.g., phenoxy), alkoxycarbonyl group (e.g., methyloxycarbonyl, ethyloxycarbonyl, butyloxycarbonyl), aryloxycarbonyl group (e.g., phenyloxycarbonyl), sulfonamido group (e.g., methanesulfonamide, ethanesulfoneamido, butanesulfoneamido, hexanesulfoneamido, cyclohexanesulfoneamido), benzenesulfoneamido), sulfamoyl group (e.g., aminosulfonyl, methylaminosulfonyl, dimethylaminosulfonyl, butylaminosulfonylhexylaminosulfonyl, cyclohexylaminosulfonyl, phenylaminosulfonyl, 2-pyridylaminosulfonyl), urethane group (e.g., methylureido, ethylureido, pentlureido, cyclohexylureido, phenylureido, 2-pyridylureido), acyl group (e.g., acetyl, propionyl, butanoyl, hexanoyl, cyclohexanoyl, benzoyl, pyridinoyl), carbamoyl group (e.g., aminocarbonyl, methylaminocarbonyl, dimethylaminocarbonyl, propylaminocarbonyl, pentylaminocarbonyl, cyclohexylaminocarbonyl, phenylaminocarbonyl, 2-pyridylaminocarbonyl), amido group (e.g., acetoamide, propioneamido, btaneamido, hexaneamido, benzamido), sulfonyl group (e.g., methylsulfinyl, ethylsulfinyl, butylsulfonyl, cyclohexylsulfonyl, phenylsulfinyl, 2-pyridylsulfonyl), amino group (e.g., amino, ethylamino, dimethylamino, butylamino, cyclopentylamino, anilino, 2-pyridylamino), cyano group, nitro group, sulfo group carboxy group, hydroxy group and oxamoyl group.

At least one of $R_1$ through $R_4$ is an alkyl group containing a hydroxy group or an alkyl group containing a group capable of forming a hydroxy group upon deprotection, and preferably an alkyl group containing a hydroxy group.

In general, a specified functional group being previously substituted by a specific substituent group so that the functional group is not affected under an environment of a specific chemical reaction refers to "protection of the functional group"; and after completion the foregoing chemical reaction, the original functional group being regenerated under specific conditions (e.g., in the presence of acid or alkali or under heating) refers to "deprotection of the functional group". The protection of a functional group and the deprotection of the protected functional group are commonly known in the art and described in many literatures, for example, "Protective Groups in Chemistry" Ed. by J. F. W. Mcomie, page 145–182, (1973, Plenum Press, London & N.Y.).

The group capable of forming a hydroxy group upon deprotection preferably is one which is capable of forming a hydroxy group by action of an acid and/or heat. Specific examples thereof include an ether group (e.g., methoxy, tert-butoxy, allyloxy, benzyloxy, triphenylmethoxy, trimethylsilyloxy). hemiacetal group (e.g., tetrahydropyranyloxy), ester group (e.g., acetyloxy, benzoyloxy, p-nitrobenzoyloxy, formyloxy, trifluoroacetyloxy, pivaloyloxy), carbonate group (or alkyloxycarbinyloxy or aryloxycarbonyloxy group, e.g., ethoxycarbonyloxy, phenoxycarbonyloxy, tert-butyloxycarbonyloxy), sulfonate group (e.g., p-toluenesulfonyloxy, benzenesulfonyloxy), carbamoyloxy group (e.g., phenylcarbamoyloxy), thiocarbonyloxy group (e.g., benzylthiocarbonyloxy), nitric acid ester group, and sulfonate group (e.g., 2,4-dinitrobenzenesulfenyloxy).

$R_1$ and $R_4$ preferably are an alkyl group having 1 to 4 carbon atoms, more preferably a secondary or tertiary alkyl group, and still more preferably a tertiary alkyl group. Specific examples of the tertiary alkyl group include tert-butyl and 1-methylcyclohexyl. $R_2$ and $R_3$ preferably are an alkyl group having 1 to 4 carbon atoms, more preferably an alkyl group substituted by a hydroxy group or a group capable of forming a hydroxy group upon deprotection, and still more preferably hydroxymethyl or 2-hydroxyethyl.

$L_1$ is —S— or —$CHR_{55}(R_{66})$—, and preferably —$CHR_{55}(R_{66})$—, in which $R_{55}$ and $R_{66}$ are each a hydrogen atom, an alkyl group, a 3- to 10-membered non-aromatic ring, an aryl group or a heteroaryl group. Specific examples of the alkyl group include methyl, ethyl, propyl, butyl, heptyl, undecyl, isopropyl, 1-ethylpentyl, 2,4-ethylpentyl, and 2,4,4-trimethylpentyl. Examples of the 3- to 10-membered non-aromatic ring group include a 3-membered ring group such as cyclopropyl, aziridinyl or oxiranyl; 4-membered ring group such as cyclobutyl, cyclobutenyl, oxetanyl or azetydinyl; a 5-membered ring such as cyclopentyl, cyclopentenyl, cyclopentadienyl, tetrahydrofuranyl, pyrolidinyl, or tetrahydrothienyl; a 6-membered ring such as cyclohexyl, cyclohexenyl, cyclohexadienyl, tetrahydrpyranyl, piperidinyl, dioxanyl, tetrahydrothiopyranyl, norcaranyl, norpyranyl or norbornyl; a 7-membered ring such as cycloheptyl, cycloheptynyl or cycloheptadienyl; a 8-membered ring such as cycloctanyl, cycloctenyl, cyclooctadienyl or cyclooctatrienyl; a 9-membered ring such as cyclononanyl, cyclononenyl, cyclononadienyl, or cyclononatrienyl; and a 10-membered ring such as cyclodecanyl, cyclodecaenyl, cyclidecadienyl or cycldecatrienyl. Of these, 3- to 6-membered rings are preferred, 5- or 6-membered rings are more preferred, and a 6-membered ring is still more preferred. Specifically, a hydrocarbon ring containing no heteroatom is preferred. These rings may combined with an other ring to form a spiro-bond through a heteroatom, or may condense with an other ring having an aromatic ring. Examples of the aryl group include phenyl, naphthyl, and anthranyl. Examples of the heteroaryl group include a imidazole group, pyrazolo group, pyridine group, pyrimidine group, pyrazine group, pyridazine group, triazole group, triazine group, indole group, indazole group, purine group, thiadiazole group, oxadiazole group, quinoline group, phthalazine group, naphthylidine group, quinoxaline group, quinazolone group, cinnoline group, pteridine group, acridine group, phenanthroline group, phenazine group, tetrazole group, thiazole group, oxazole group, benzimidazole group, benzoxazole group, benzthiazole group, indolenine group, and tetrazaindene group. The foregoing groups may further be substituted. Examples of such a substituent include the same as defined in $R_1$ through $R_4$.

$R_{55}$ preferably is a hydrogen atom, isopropyl, 2,4,4-trimethylpentyl, or a 5- or 6-membered non-aromatic ring group (such as cyclohexyl or cyclohexenyl). $R_{66}$ preferably is a hydrogen atom.

$X_1$ and $X_2$ are each a group capable of being substituted on a benzene ring. Specific examples of substituents include an alkyl group having 1 to 25 carbon atoms (e.g., methyl, ethyl, propyl, isopropyl, tert-butyl, pentyl, hexyl, cyclohexyl), halogenated alkyl group (e.g., trifluoromethyl, perfluorooctyl), cycloalkyl group (e.g., cyclohexyl, cycloheptyl), alkynyl group (e.g., propargyl), glycidyl group, acrylate group, methacrylate group, aryl group, heterocyclic group (e.g., pyridyl, thiazolyl, oxazolyl, imidazolyl, furyl, pyrrolyl, pyrazinyl, pyrimidinyl, pyridazinyl, selenazolyl, sulforanyl, piperidinyl, pyrazolyl, tetrazolyl), alkoxy group (e.g., methoxy, ethoxy, propoxy, pentyloxy, cyclopentyloxy, hexyloxy, cyclohexyloxy) aryloxy group (e.g., phenoxy), alkoxycarbonyl group (e.g., methyloxycarbonyl, ethyloxycarbonyl, butyloxycarbonyl), aryloxycarbonyl group (e.g., phenyloxycarbonyl), sulfonamido group (e.g., methanesulfonamide, ethanesulfoneamido, butanesulfoneamido, hexanesulfoneamido, cyclohexanesulfoneamido), benzenesulfoneamido), sulfamoyl group (e.g., aminosulfonyl, methylaminosulfonyl, dimethylaminosulfonyl, butylaminosulfonylhexylaminosulfonyl, cyclohexylaminosulfonyl, phenylaminosulfonyl, 2-pyridylaminosulfonyl), urethane group (e.g., methylureido, ethylureido, pentlureido, cyclohexylureido, phenylureido, 2-pyridylureido), acyl group (e.g., acetyl, propionyl, butanoyl, hexanoyl, cyclohexanoyl, benzoyl, pyridinoyl), carbamoyl group (e.g., aminocarbonyl, methylaminocarbonyl, dimethylaminocarbonyl, propylaminocarbonyl, pentylaminocarbonyl, cyclohexylaminocarbonyl, phenylaminocarbonyl, 2-pyridylaminocarbonyl), amido group (e.g., acetoamide, propioneamido, btaneamido, hexaneamido, benzamido), sulfonyl group (e.g., methylsulfinyl, ethylsulfinyl, butylsulfonyl, cyclohexylsulfonyl, phenylsulfinyl, 2-pyridylsulfonyl), amino group (e.g., amino, ethylamino, dimethylamino, butylamino, cyclopentylamino, anilino, 2-pyridylamino), cyano group, nitro group, sulfo group carboxy group, hydroxy group and oxamoyl group. The foregoing substituent groups may further be substituted; n and m are each an integer of 0 to 2, and both of them preferably are 0.

In formula (2), $R_5$ and $R_6$ are each a hydrogen atom or an alkyl group. Examples of the alkyl group include methyl, ethyl propyl, isopropyl, tert-butyl, pentyl, and hexyl. Specifically, both of $R_5$ and $R_6$ are hydrogen atoms. Further, p and q are each an integer of 0 to 5 and preferably an integer of 1 to 3, and still more preferably p=q=2.

Specific examples of the compounds represented by formula (1) or (2) are shown below, but the present invention is by no means limited to these.

R-1

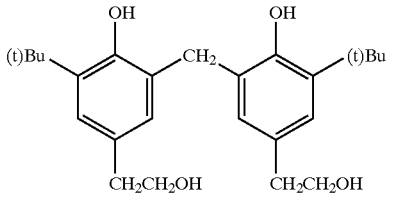

R-2

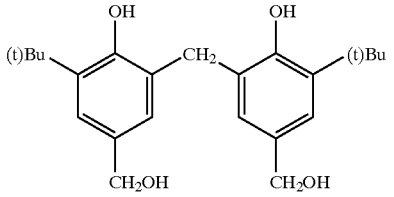

R-3

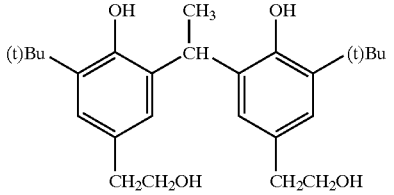

R-4

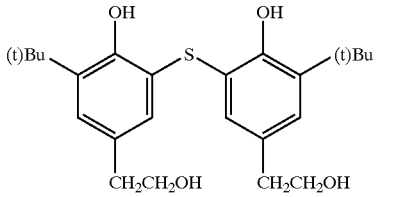

R-5

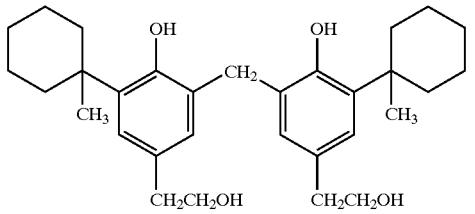

R-6

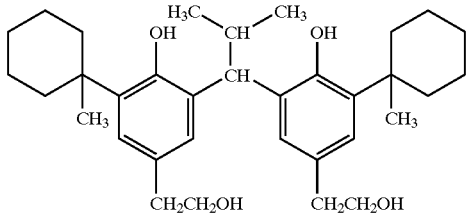

-continued
R-7
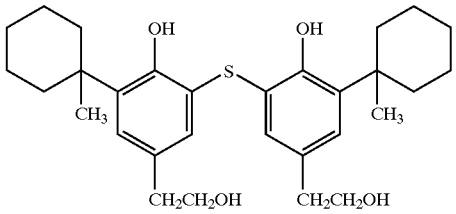
R-8
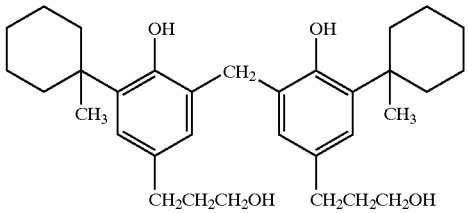
R-9
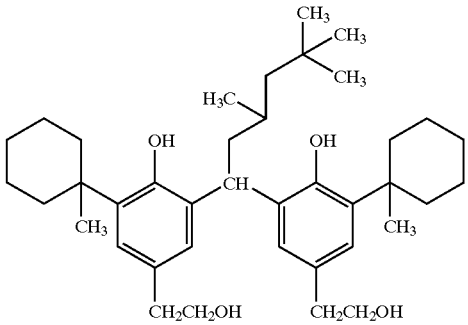
R-10
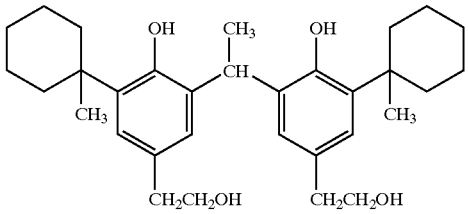
R-11
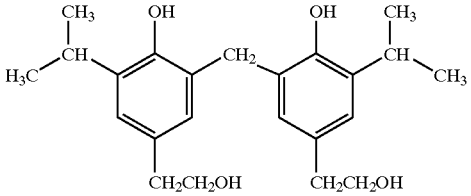
R-12
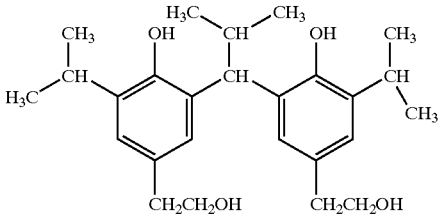
R-13
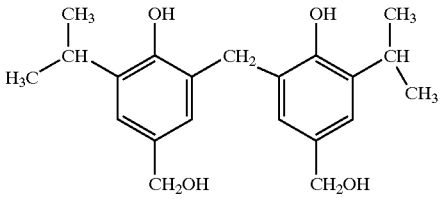
-continued
R-14
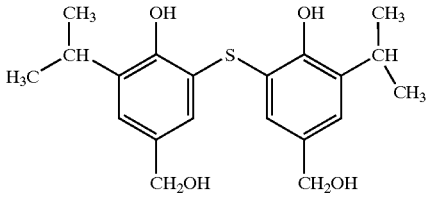
R-15
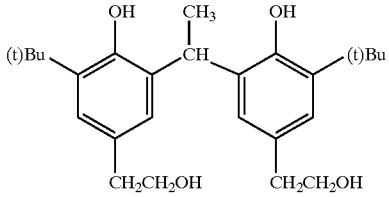
R-16
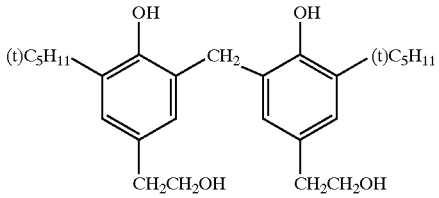
R-17
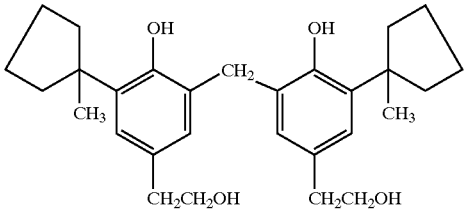
R-18
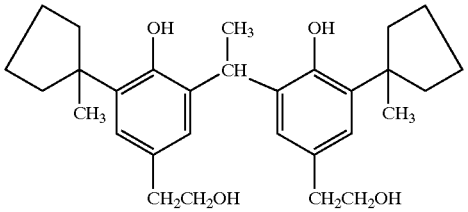
R-19
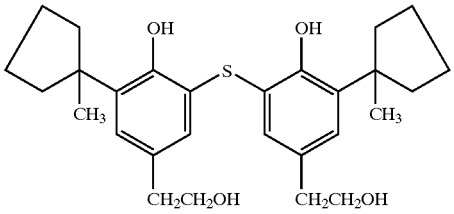
R-20
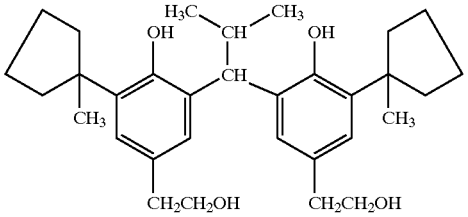

-continued
R-21
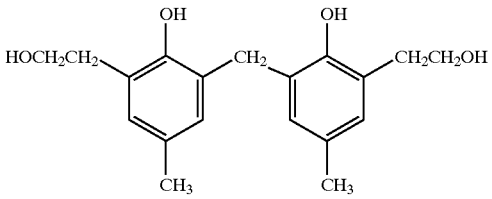
R-22
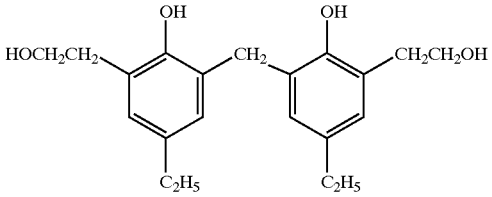
R-23
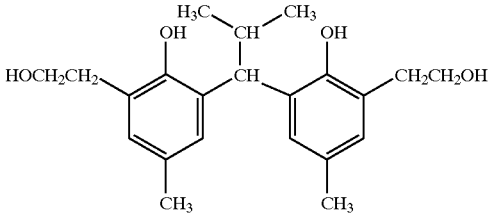
R-24
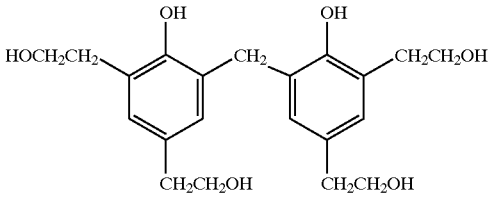
R-25
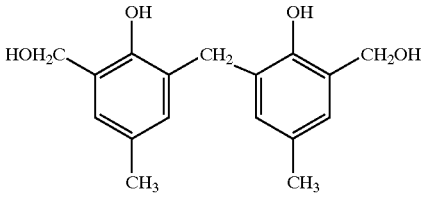
R-26
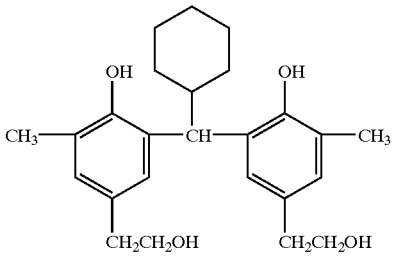
R-27
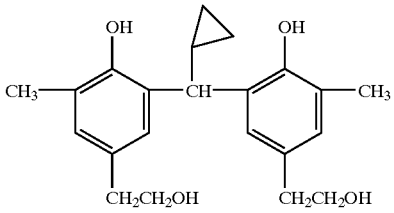
-continued
R-28
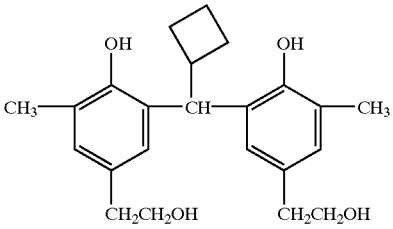
R-29
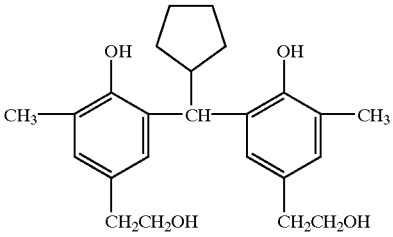
R-30
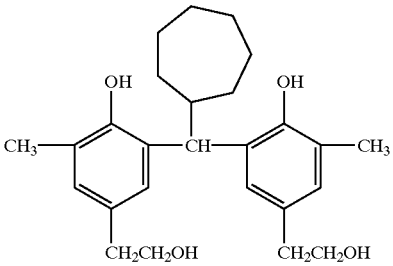
R-31
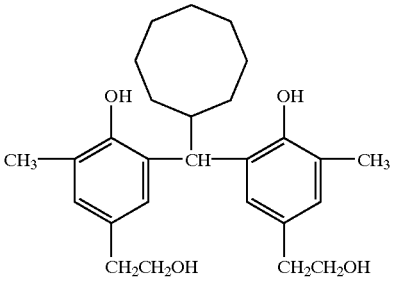
R-32
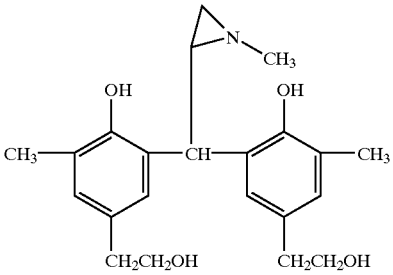
R-33
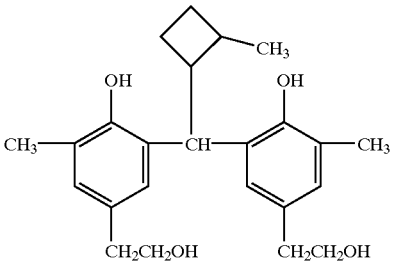

-continued
R-34
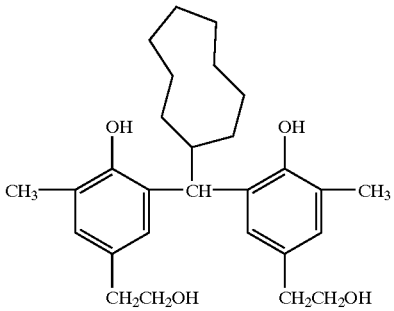
R-35
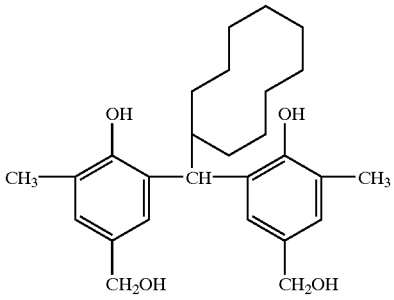
R-36
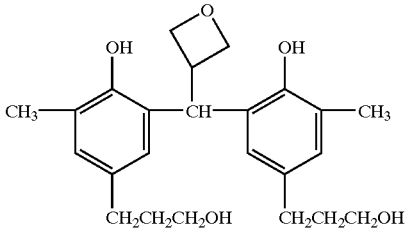
R-37
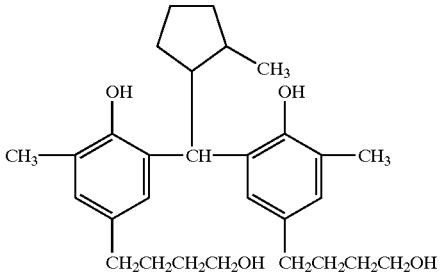
R-38
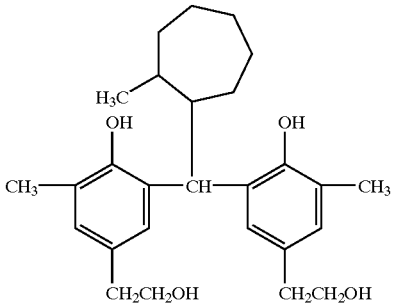
-continued
R-39
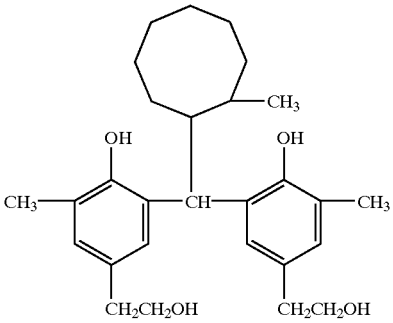
R-40
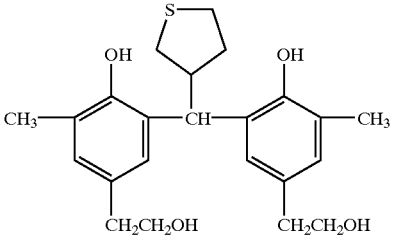
R-41
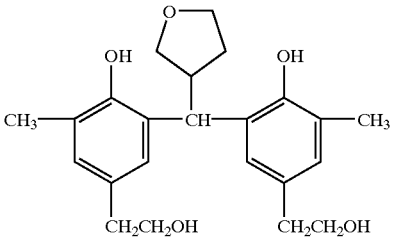
R-42
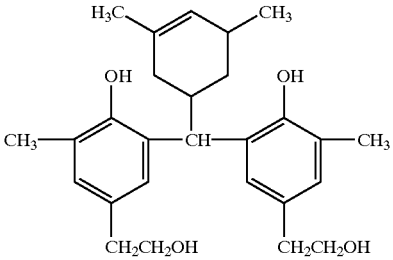
R-43
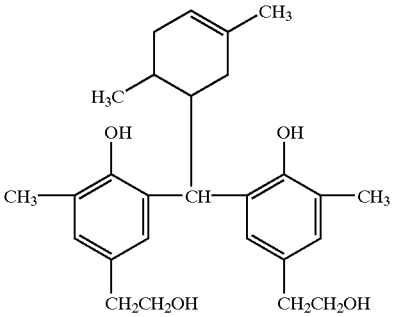

-continued
R-44
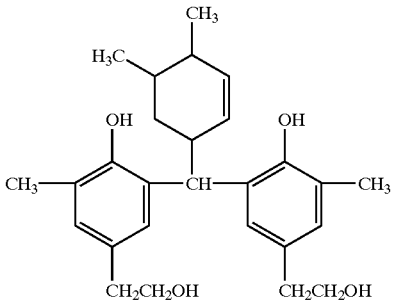
R-45
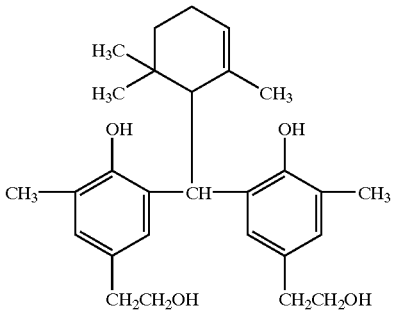
R-46
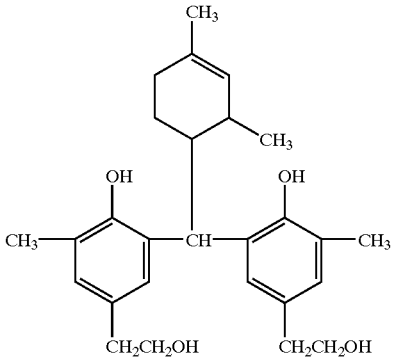
R-47
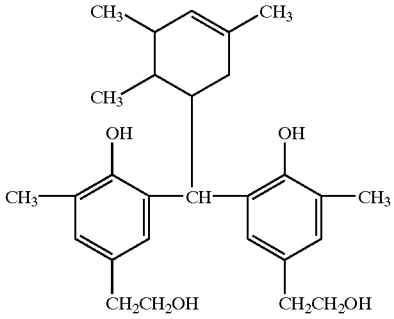
-continued
R-48
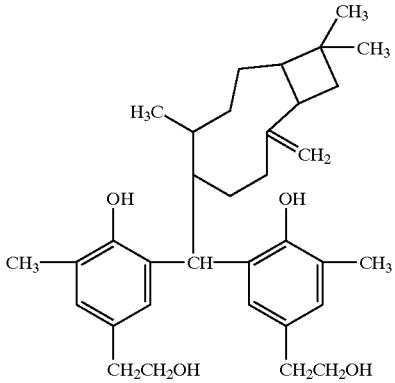
R-49
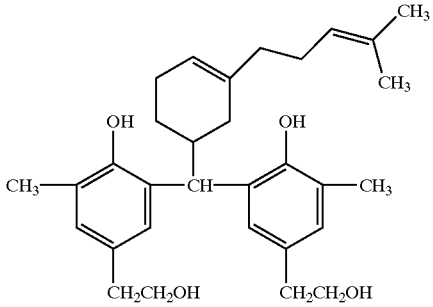
R-50
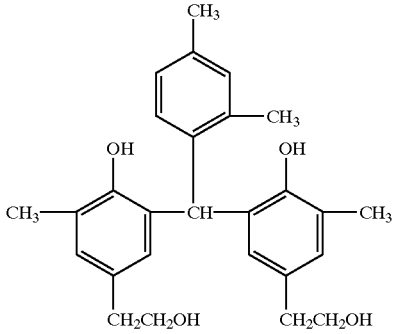
R-51
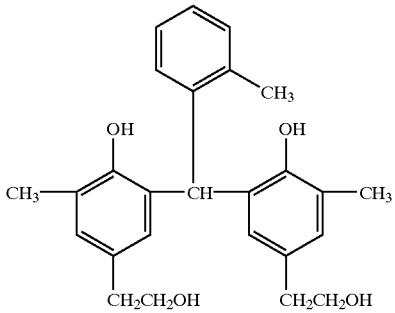
R-52
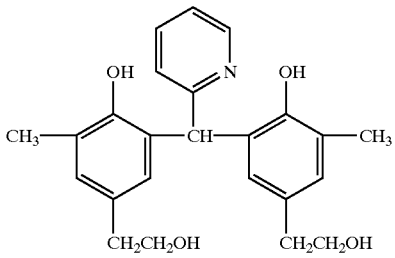

-continued

R-53

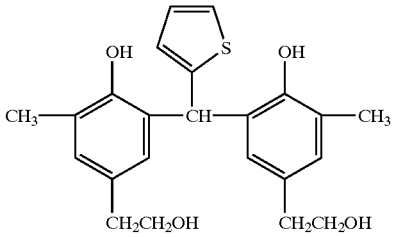

R-54

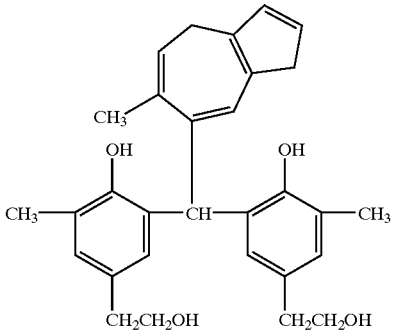

R-55

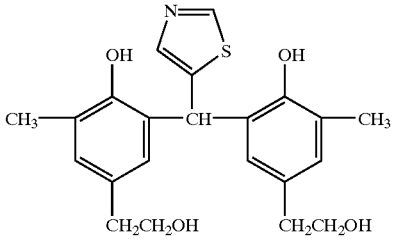

R-56

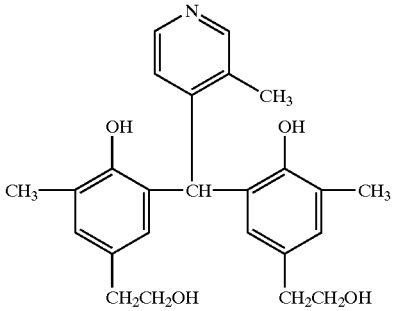

R-57

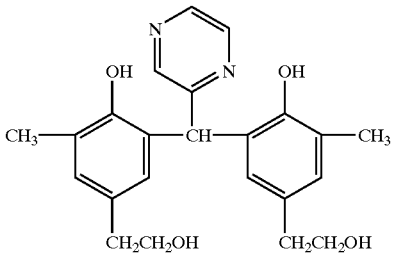

-continued

R-58

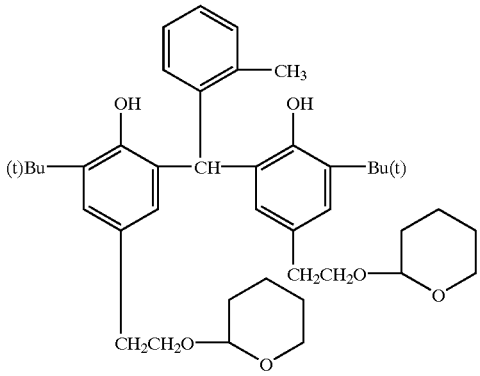

R-59

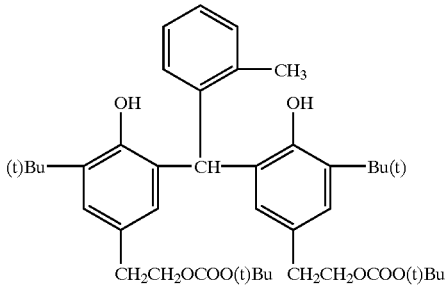

The compounds represented by the foregoing formulas (1) and (2) can be readily synthesized according to methods known in the art. Preferred reaction scheme is shown below, based on exemplified compound R-3.

R-3

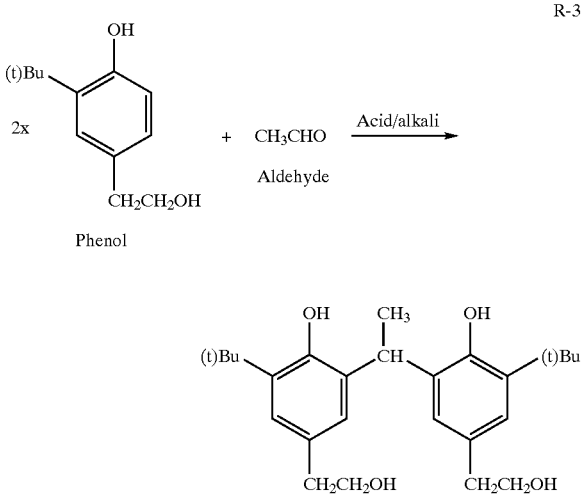

Two equivalents of phenol and one equivalent of aldehyde are dissolved or suspended in the absence or presence of an appropriate organic solvent and are reacted preferably at a temperature of −20 to 180° C. for a period of 0.5 to 60 hrs with adding a catalytic amount of an acid or alkali to obtain the intended compound R-3 at a high yield. Other exemplified compounds can also be obtained in a similar manner.

The organic solvent preferably is a hydrocarbon type organic solvent and examples thereof include benzene, toluene, xylene, dichloromethane, and choroform; and toluene and xylene are preferred. It is preferred to perform the reaction without using an organic solvent in terms of yield. Any acid of inorganic acids and organic acids can be usable as an acid catalyst and concentrated hydrochloric acid, p-toluenesulfonic acid and phosphoric acid are preferably employed. Preferred examples of an alkali catalyst include caustic soda (sodium hydroxide), caustic potash potassium hydroxide), triethylamine, 1,8-diazabicyclo-[5.4.0]-7-undecene (DBU), and sodium methylate. The catalytic amount preferably is 0.001 to 1.5 equivalent with respect to a corresponding aldehyde. The reaction temperature preferably is 15 to 150° C. and the preferred reaction time is 3 to 20 hrs.

The reducing agent compound represented by formula (1) or (2) may be used alone or in combination. The reducing agent may also used in combination with other reducing agents. Examples of other reducing agents usable in combination with the reducing agent of formula (1) or (2) are described in JP-A No. 11-65021, paragraph No. 0043 to 0045; European Patent No. 0803764A1, page 7, line 34 to page 18, line 12. Specifically, bisphenol type reducing agents [e.g., 1,1-bis-(2-hydroxy-3,5-dimethylphenyl)-3,5,5-trimethylhexane] are preferred in the photothermographic material relating to this invention.

The reducing agent represented by formula (1) or (2) is preferably incorporated into an image forming layer containing organic silver salts but may be incorporated into a non-imaging layer adjacent to the image forming layer. The reducing agent may be added to a coating solution, in any form, such as solution, emulsified dispersion, solid particle dispersion and the like to form a photothermographic material.

There are also usable as a reducing agent for silver ions polyphenol compounds described in U.S. Pat. Nos. 3,589,903 and 4,021,249, British Patent No. 1,486,148, JP-A No. 51-51933, 50-36110, 50-116023 and 52-84727, and JP-B No. 51-35727 (hereinafter, the term, JP-B refers to Japanese Patent Publication), such as 2,2'-dihydroxy-1,1-binaphthyl and 6,6'-dibromo-2,2'-dihydroxy-1,1'-binaphthyl; sulfonamidophenols and sulfonamidonaphthols such as 4-benzenesulfonamidophenol, 2-benzenesulfonamidophenol, 2,6-dichloro-4-benzenesulfonamidophenol and 4-benzenesulfonamidonaphthol, as described in U.S. Pat. No. 3,801,321.

An amount of the reducing agent used, depending on the kind of an organic silver salt, reducing agent or other additives is usually 0.05 to 10 mol, and preferably 0.1 to 3 mol per mol of organic silver salt. It is preferred that the reducing agent is added to a light-sensitive emulsion solution comprising light-sensitive silver halide, particulate organic silver salt and a solvent immediately before coating, thereby reducing variation in photographic performance, due to standing time.

Next, the silver saving agent will be described. The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver.

Examples of the preferred silver-saving agent include hydrazine derivative compounds represented by the following formula (H), vinyl compounds represented by formula (G) and quaternary onium compounds represented by formula (P):

formula (H)

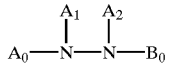

formula (G)

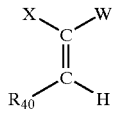

formula (P)

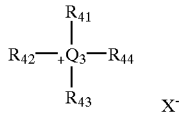

In formula (H), $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)—, —SO—, —$SO_2$— or —P(O)($G_1D_1$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or —$G_0$—$D_0$ group represented by $A_0$ each may be substituted. Specifically preferred $A_0$ is an aryl group or —$G_0$—$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert. The group for promoting adsorption to silver halide includes a thioureido group, thiourethane, mercapto group, thioether group, thione group, heterocyclic group, thioamido group, mercapto-heterocyclic group or a adsorption group as described in JP A No. 64-90439.

In formula (H), $B_0$ is a blocking group, and preferably —$G_0$—$D_0$, wherein $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

The compounds represented by formula (H) can be readily synthesized according to commonly known methods, for example, as described in U.S. Pat. Nos. 5,464,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In formula (G), X and $R_{40}$ may be either cis-form or trans-form. The structure of its exemplary compounds is also similarly included.

In formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

$R_{40}$ is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam.

In formula (G), the electron-withdrawing group represented by X refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium group, and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by $R_{40}$, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

In formula (P), $Q_3$ is a nitrogen atom or a phosphorus atom; $R_{41}$, $R_{42}$, $R_{43}$ and $R_{44}$ each are a hydrogen atom or a substituent, provided that $R_{41}$, $R_{42}$, $R_{43}$ and $R_{44}$ combine together with each other to form a ring; and $X^-$ is an anion.

Examples of the substituent represented by $R_{41}$, $R_{42}$, $R_{43}$ and $R_{44}$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_{41}$, $R_{42}$, $R_{43}$ and $R_{44}$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_{41}$, $R_{42}$, $R_{43}$ and $R_{44}$ are each preferably a hydrogen atom or an alkyl group. Examples of the anion of $X^-$ include a halide ion, sulfate ion, nitrate ion, acetate ion and p-toluenesulfonic acid ion.

The quaternary onium salt compounds described above can be readily synthesized according to the methods commonly known in the art. For example, the tetrazolium compounds described above may be referred to Chemical Review 55, page 335–483.

As the silver-saving agent is more preferred a compound represented by the following formula (X):

formula (X)

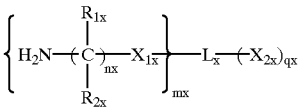

wherein $R_{1x}$ and $R_{2x}$ are each a hydrogen atom or a substituent; $X_{1x}$ is —S—, —O— or —N($R_{3x}$)—, in which $R_{3x}$ is a hydrogen atom or substituent; nx is 2 or 3; mx is an integer of 1 to 3; $X_{2x}$ is a ballast group, an adsorption group onto silver halide or a silyl group; qx is an integer of 1 to 3; and $L_x$ is a di- to hexa-valent linkage group.

In the formula, $R_{1x}$ and $R_{2x}$ are each a hydrogen atom or a substituent. Specific examples of substituents include an alkyl group having 1 to 25 carbon atoms (e.g., methyl, ethyl, propyl, isopropyl, tert-butyl, pentyl, hexyl, cyclohexyl), halogenated alkyl group (e.g., trifluoromethyl, perfluorooctyl), cycloalkyl group (e.g., cyclohexyl, cycloheptyl), alkynyl group (e.g., propargyl), glycidyl group, acrylate group, methacrylate group, aryl group, heterocyclic group (e.g., pyridyl, thiazolyl, oxazolyl, imidazolyl, furyl, pyrrolyl, pyrazinyl, pyrimidinyl, pyridazinyl, selenazolyl, sulforanyl, piperidinyl, pyrazolyl, tetrazolyl), alkoxy group (e.g., methoxy, ethoxy, propoxy, pentyloxy, cyclopentyloxy, hexyloxy, cyclohexyloxy) aryloxy group (e.g., phenoxy), alkoxycarbonyl group (e.g., methyloxycarbonyl, ethyloxycarbonyl, butyloxycarbonyl), aryloxycarbonyl group (e.g., phenyloxycarbonyl), sulfonamido group (e.g., methanesulfonamide, ethanesulfoneamido, butanesulfoneamido, hexanesulfoneamido, cyclohexanesulfoneamido), benzenesulfoneamido), sulfamoyl group (e.g., aminosulfonyl, methylaminosulfonyl, dimethylaminosulfonyl, butylaminosulfonylhexylaminosulfonyl, cyclohexylaminosulfonyl, phenylaminosulfonyl, 2-pyridylaminosulfonyl), urethane group (e.g., methylureido, ethylureido, pentlureido, cyclohexylureido, phenylureido, 2-pyridylureido), acyl group (e.g., acetyl, propionyl, butanoyl, hexanoyl, cyclohexanoyl, benzoyl, pyridinoyl), carbamoyl group (e.g., aminocarbonyl, methylaminocarbonyl, dimethylaminocarbonyl, propylaminocarbonyl, pentylaminocarbonyl, cyclohexylaminocarbonyl, phenylaminocarbonyl, 2-pyridylaminocarbonyl), amido group (e.g., acetoamide, propioneamido, btaneamido, hexaneamido, benzamido), sulfonyl group (e.g., methylsulfinyl, ethylsulfinyl, butylsulfonyl, cyclohexylsulfonyl, phenylsulfinyl, 2-pyridylsulfonyl), amino group (e.g., amino, ethylamino, dimethylamino, butylamino, cyclopentylamino, anilino, 2-pyridylamino), cyano group, nitro group, sulfo group carboxy group, hydroxy group and oxamoyl group. The foregoing substituent groups may further be substituted. $R_{1x}$ and $R_{2x}$ are preferably a hydrogen atom or an alkyl group having 1 to 3 carbon atoms, and more preferably a hydrogen atom.

$R_{3x}$ is a hydrogen atom or a substituent. Examples of the substituent include the same as defined in $R_{1x}$ and $R_{2x}$. $R_{3x}$ preferably is a hydrogen atom or an alkyl group having 1 to 3 carbon atoms, and more preferably a hydrogen atom.

$X_{1x}$ is —S—, —O— or —N($R_{3x}$)—, preferably —N($R_{3x}$)—, and more preferably —NH—; nx is 2 or 3, and preferably 2; mx is an integer of 1 to 3, preferably 1 or 2, and more preferably 1.

$X_{2x}$ is a ballast group, an adsorption group onto silver halide or a silyl group. The ballast group preferably is an aliphatic group having 6 or more carbon atoms or an aryl group containing an alkyl group having 3 or more carbon atoms. Non-diffusibility depends on amounts of a binder or crosslinking agent used a system but introduction of the ballast group inhibits travel in the system at room temperature, enhancing aging stability. The non-diffusibility can be evaluate in the following manner. Thus, A binder is put into a capillary with opened edges and cross-linked; a test compound is brought into contact with one of the opened areas. After the elapse of a prescribed time at a given temperature, a traveling quantity is determined by means of infrared spectroscopy, mass spectrometry, an isotope method or NMR method. The extent of diffusion can be determined by varying temperature or time. It is possible to retard diffusion 100 to $10^8$ times but excessively inhibiting diffusion deteriorates inherent functions, so that introduction of a group retarding the diffusion rate at room temperature to a level of 10 to $10^8$ times is appropriate.

Examples of the adsorption group include an aromatic group, sulfur or nitrogen containing group, an alkylene group and a carboxyl group. Preferred examples thereof include a mercapto group, thioether group, thioureido group, primary to tertiary amino groups and nitrogen containing heterocyclic groups such as pyridine group, quinoline group, isoquinoline group, imidazole group, pyrazolo group, triazole group, oxazole group, thiazole group, oxadiazole group, thiadiazole group, and tetrazole group. The adsorption group can be evaluated in terms of an adsorption amount according to the following manner. Test material is added to a solution containing silver halide and after filtering out the silver, the solution is measured with respect to concentration of the test material to determine an adsorption amount onto silver halide. The adsorption amount depending on silver ion concentration of the silver halide solution, and silver halide grain form and size is preferably measured under conditions of silver halide grain form and size, and potential at the time when added to an organic silver salt. In one preferred embodiment, cubic, octahedral ot tabular silver bromide containing 0.1 to 10 mol % iodide and having an average grain size of 10 to 300 nm is allowed to stand at a pAg of 6 to 8 and a temperature of 25±5° C. for 1 to 48 hrs. and then measured with respect to adsorption amount. There may be measured silver bromide or silver chloride containing no iodide. Coverage of the silver halide grain surface within the range of 3 to 100% is judged to be adsorptive. The adsorption test is preferably conducted using a silver halide emulsion not containing a dye, stabilizer or antifoggant. However, there may be used silver halide emulsions used in practice containing a dye, stabilizer or antifoggant.

Examples of the silyl group include silyl group and silyl groups substituted by hydroxy, alkyl, aryl, halogen, amino, siloxy, alkoxy or aryloxy group. An silyl group substituted by an alkoxy group having 1 to 3 carbon atoms, and triethoxysilyl or trimethoxysilyl is more preferred.

In the formula (X), qx is an integer of 1 to 3, preferably 1 or 2, and more preferably 1. Lx is di- to hexa-valent linkage group, and preferably di-valent linkage group.

Examples of the linkage group include an alkylene group, arylene group, heteroarylene group, heterocyclic group, heteroatom (e.g., oxygen, nitrogen, sulfur) and their combination, and an alkylene group having 2 to 4 carbon atoms is preferred.
Specific examples of the compound represented by formula (X) are shown below, but are by no means limited to these.
(1)-1
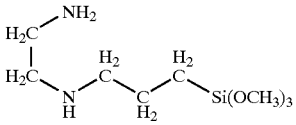
(1)-2
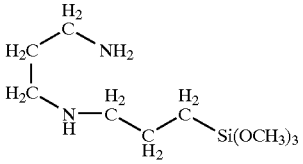
(1)-3
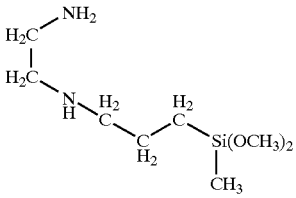
(1)-4
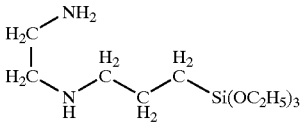
(1)-5
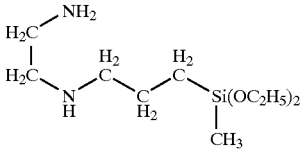
(1)-6
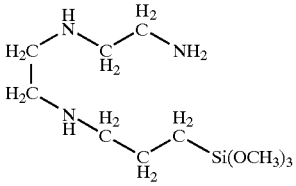
(1)-7
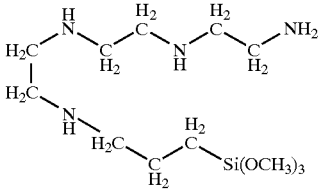
(1)-8
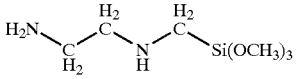
-continued
(1)-9
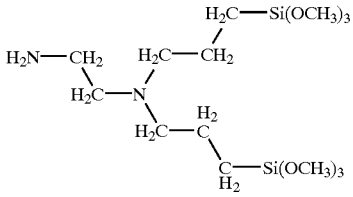
(1)-10
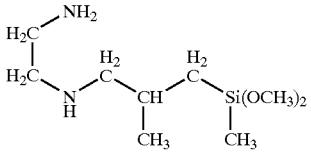
(1)-11
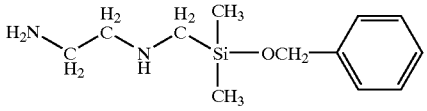
(1)-12
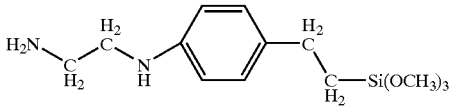
(1)-13
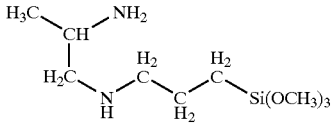
(1)-14
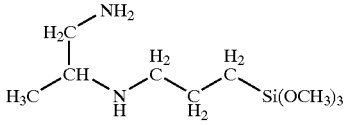
(1)-15
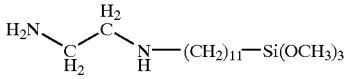
(1)-16
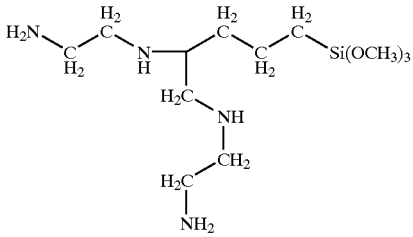
(1)-17
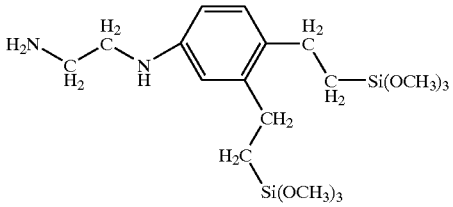
(1)-18
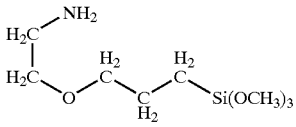

-continued (1)-19

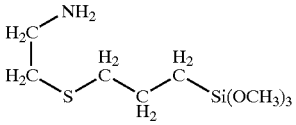

(1)-20

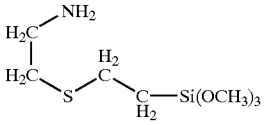

(1)-21

$NH_2CH_2CH_2NHCH_2CH_2OH$ (1)-22

$NH_2CH_2CH_2NHCH_2CH_2CH_2NHCH_2CH_2NH$ (1)-23

$NH_2CH_2CH_2NHCH_2CH_2NH_2$ (1)-24

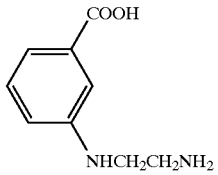

(1)-25

$NH_2CH_2CH_2NHCH_2CH_2COOH$ (1)-26

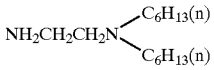

(1)-27

$NH_2(CH_2CH_2NH)_4CH_2CH_2NH_2$ (1)-28

$NH_2(CH_2CH_2NH)_3CH_2CH_2NH_2$ (1)-29

$NH_2CH_2CH_2NH(CH_2)_{11}CH_3$ (1)-30

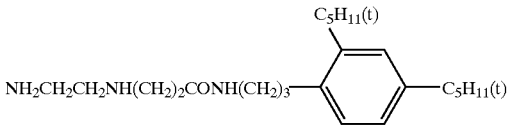

(1)-31

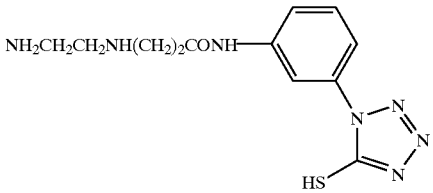

(1)-32

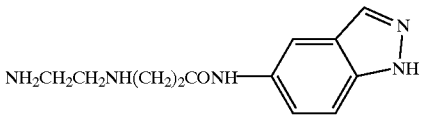

(1)-33

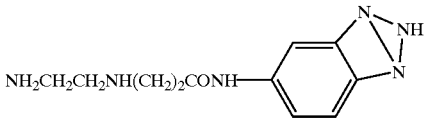

(1)-34

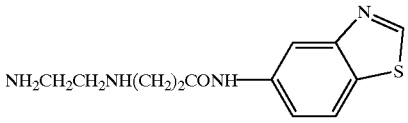

-continued (1)-35

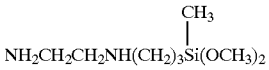

The photothermographic material may contain the silver-saving agent alone or the combination thereof. The silver-saving agent is preferably incorporated into an image forming layer containing organic silver salts but may be incorporated into a non-imaging layer adjacent to the image forming layer. The amount thereof is $10^{-5}$ to 1 mol, and preferably $10^{-4}$ to $5\times10^{-1}$ mol per mol of light-insensitive organic silver salt.

The silver-saving agent may be added to a coating solution, in any form, such as solution, emulsified dispersion, solid particle dispersion and the like to form a photothermographic material. In cases when added in the form of solution, for example, the silver-saving agent is dissolved in a low boiling solvent such as ethyl acetate, methyl ethyl ketone, toluene, methanol or cyclohexane, followed by added into the coating solution. In cases when added in the form of emulsified dispersion, the silver-saving agent is dissolved in oil (or high boiling solvent) such as dibutyl phthalate, tricresyl phosphate, glyceryltriacetate or diethyl phthalate using an auxiliary solvents such as ethyl acetate, methyl ethyl ketone or cyclohexane, followed by being mechanically dispersed and added into the coating solution. In the case of being added in the form of solid particle dispersion, a powdery silver-saving agent such as a compound of formula (X) is dispersed in an appropriate solvent by means of a ball mil, colloid mill, vibration mill, sand mill, jet mill, roller mill or ultrasonic mixer and the formed solid particle dispersion is added into the coating solution. In this case, there may be used protective colloid (e.g., polyvinyl alcohol), surfactant (e.g., anionic surfactant, such as sodium triisopropylnaphthalenesulfonate, mixture of those differing in substitution position for three isopropyl groups). There may be added an antiseptic agent (e.g., benzothiazolinone sodium salt) to aqueous dispersion. In this invention, the silver-saving agent is preferably incorporated to a coating solution, in the form of solution or solid particle dispersion.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in Research Disclosure (hereinafter, also denoted simply as RD) 17029 and 29963. Silver salts of behenic acid, arachidic acid and/or stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed.

The organic silver salt is preferably comprised of monodisperse grains having an average size of 1 μm or less. In cases where the organic silver grains are spherical, needle-like, or tabular grains, the grain size of the organic silver salt refers to a diameter of a sphere having a volume equivalent to that of the grain. The average grain size preferably is 0.01 to 0.8 μm, and more preferably 0.05 to 0.5 mm. The expression being monodisperse is the same mean as defined in the case of silver halide, as described later, and monodispersibility preferably is 1 to 30%. The organic silver salt used in this invention being monodisperse grains having an average size of 1 μm or less leads to images having a higher density. At least 60% of the organic silver salt is preferably accounted for by tabular grain, based on the total grain projected area. The tabular grain refers to the grain having at least 3 of an aspect ratio, i.e., the ratio of grain diameter to grain thickness (also denoted simply as AR), as defined below:

AR=grain diameter (in μm)/grain thickness (in μm).

Methods to prepare organic silver salt grains having the above-mentioned shape are not particularly restricted. The optimization of various conditions such as maintaining the mixing state during the formation of an organic acid alkali metal salt soap and/or the mixing state during the addition of silver nitrate to said soap. After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer) may be employed.

In devices employed for dispersing the tabular organic silver salt grains employed in the present invention, preferably employed as the members which are in contact with the organic silver salt grains are ceramics such as zirconia, alumina, silicone nitride, boron nitride, or diamond. Of these, zirconia is the one most preferably employed. The content of the zirconia in a light sensitive emulsion containing light sensitive silver halide and an organic silver salt is preferably 0.01 to 0.5 mg, and more preferably 0.01 to 0.3 mg per g of silver. When the dispersing procedure described above is performed, it is preferred to optimize the binder concentration, preliminary dispersing method, dispersing machine operation conditions and the dispersing number to obtain organic silver salt grains.

Light-sensitive silver halide having less average grain size is preferred to minimize cloudiness after image formation and to obtain excellent image quality, and the average grain size is preferably not more than 0.1 μm, more preferably between 0.01 and 0.1 μm, and still more preferably between 0.02 and 0.08 μm. The grain size refers to the diameter of a circle having an area equivalent to that of the grain which is observed by an electron microscope (i.e., equivalent circle diameter). Furthermore, silver halide grains are preferably monodisperse grains. The monodisperse grains as described herein refer to grains having a monodispersibility (i.e., coefficient of variation of grain size) obtained by the formula described below of not more than 40%; more preferably not more than 30%, and still more preferably not more than 20%:

Monodispersibility=(standard deviation of grain diameter)/(average grain diameter)×100(%)

The shape of silver halide grains is not specifically limited, and the high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Another preferred grain shape of light-sensitive silver halide is a tabular grain. In this invention, the tabular silver halide grain having aspect ratio (or r/h) of 3 or more (preferably 3 to 50), in which a square root of the grain projected area is r μm and a thickness in the vertical direction is h μm. The grain diameter of the tabular grain is preferably not more than 0.1 μm, and more preferably 0.01 to 0.08 μm. Tabular grains are described in U.S. Pat. Nos. 5,264,336, 5,314,798 and 5,320,958, in which intended tabular grains can be readily obtained.

The halide composition of silver halide is not specifically limited and may be any one of silver chloride, silver chlorobromide, silver iodochlorobromide, silver bromide, silver iodobromide and silver iodide. Silver halide grain emulsions usable in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964).

Light-sensitive silver halide used in the invention preferably occludes ions of metals belonging to Groups 6 to 11 of the Periodic Table. Preferred as the metals are W, Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

general formula $$(ML_6)^m$$

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different. M is preferably rhodium (Rh), ruthenium (Ru), rhenium (Re), iridium (Ir) or osmium (Os). Exemplary examples of transition metal-coordinated complexes include $[RhCl_6]^{3-}$, $[RuCl_6]^{3-}$, $[ReCl_6]^{3-}$, $[RuBr_6]^{3-}$, $[OsCl_6]^{3-}$, $[IrCl_6]^{4-}$, $[Ru(NO)Cl_5]^{2-}$, $[RuBr_4(H_2O)]^{2-}$, $[Ru(NO)(H_2O)Cl_4]^-$, $[RhCl_5(H_2O)]^{2-}$, $[Re(NO)Cl_5]^{2-}$, $[Re(NO)(CN)_5]^{2-}$, $[Re(NO)Cl(CN)_4]^{2-}$, $[Rh(NO)_2Cl_4]^-$, $[Rh(NO)(H_2O)Cl_4]^-$, $[Ru(NO)(CN)_5]^{2-}$, $[Fe(CN)_6]^{3-}$, $[Rh(NS)Cl_5]^{2-}$, $[Os(NO)Cl_5]^{2-}$, $[Cr(NO)Cl_5]^{2-}$, $[Re(NO)Cl_5]^-$, $[Os(NS)Cl_4(TeCN)]^{2-}$, $[Ru(NS)Cl_5]^{2-}$, $[Re(NS)Cl_4(SeCN)]^{2-}$, $[Os(NS)Cl(SCN)_4]^{2-}$, $[Ir(NO)Cl_5]^{2-}$ and $[Ir(NS)Cl_5]^{2-}$.

The foregoing metal ions, metal complexes or complex metal ions are used alone or in combination. The content thereof is usually $1\times10^{-9}$ to $1\times10^{-2}$ mol, and preferably $1\times10^{-8}$ to $1\times10^{-4}$ mol per mol of silver halide.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain. These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

The light-sensitive silver halide grains used in this invention preferably are chemically sensitized. Preferred chemical sensitization includes commonly known sulfur sensitization, selenium sensitization and tellurium sensitization. There are also usable noble metal sensitization using gold compounds or platinum, palladium or iridium compounds, and reduction sensitization.

Preferred compounds used in the sulfur sensitization, selenium sensitization and tellurium sensitization include commonly known compounds, as described in JP-A 7-128768. Examples of the tellurium sensitizer include diacyltellurides, bis(oxycarbonyl)tellurides, bis(carbamoyl) tellurides, diacylditellurides, bis(oxycarbonyl)ditellurides, and bis(carbamoyl)ditellurides, compounds containing P=Te bond, tellurocarboxylates, Te-organyltellurocarboxylic acid esters, di(poly)tellurides, tellurides, tellurols, telluroacetals, tellurosulfonates, compounds containing P—Te bond, Te-containing heterocyclic compounds, tellurocarbonyl compounds, inorganic tellurium compounds and colloidal tellurium. Compounds used for noble metal sensitization include, for example, chloroauric acid, potassium aurate, potassium aurithionatem gold sulfide, gold selenide and compounds described in U.S. Pat. No. 2,448,060 and British Patent No. 618,061. Compounds used for reduction sensitization include, for example, ascorbic acid, thiourea dioxide, tin(II) chloride, aminoiminomethanesulfinic acid, hydrazine derivatives, borane compounds, silane compounds, and polyamine compounds. Reduction sensitization is also performed by ripening a silver halide emulsion at a pH of 7 or more, or at a pAg of 8.3 or less. Reduction sensitization can be performed by single addition of silver ions during grain formation.

Next, explanation will be given of constituent elements of the photothermographic material relating to this invention.

The photothermographic material relating to this invention comprises on the support an image forming layer containing organic silver salt, light-sensitive silver halide and a reducing agent, and a protective layer in this order. There may optionally be provided an interlayer between the image forming layer and the protective layer. The photothermographic material is preferably provided with a backing layer on the opposite side of the image forming layer to prevent blocking with the protective layer. The foregoing respective layers may each be a single layer or plural layers differing in composition.

There are used various binder resins to form the foregoing layers. As binder resin are optionally employed commonly known transparent or translucent resins, including, for example, poly(vinyl acetal) type resin such as poly(vinyl formal), poly(vinyl acetoacetal); cellulose type resin such as ethyl cellulose, hydroxyethyl cellulose and cellulose acetate bytyrate; styrene type resin such as polystyrene, copolymer of styrene and acrylonitrile, and copolymer of styrene acrylonitrile; polyvinyl chloride type resin such as polyvinyl chloride and chlorinated polypropylene; polyester, polyurethane, polyarylate, epoxy resin and acryl type resin. These resins may be used alone or in combination thereof. The above-described binder resin can also be optionally used in the protective layer, interlayer or back layer. Furthermore, an epoxy group containing compound and acryl group containing compound that are actinic ray-hardenable may also employed as a layer forming resin.

In this invention, aqueous miscible binder resin is also preferably used. Preferred resins thereof include a aqueous soluble polymer and aqueous dispersible hydrophobic polymer (latex), for example, copolymers such as polyvinylidene chloride, poly[(vinylidene chloride)-co-(acrylic acid)], poly [(vinylidene chloride)-co-(itaconic acid)], poly(sodium acrylate), poly(ethylene oxide), poly[(acrylic acid amide)-co-(anhydrous maleic acid)], poly(acrylonitrile-co-butadiene), poly[(vinyl chloride)-co-(vinyl acetate)], and poly[styrene-co-butadiene-co-(acrylic acid)]. These polymers constitute aqueous coating solution, which is coated and dried to form a uniform resin layer. Using these polymers, ingredients such as an organic silver salt, silver halide and reducing agent are dispersed and mixed with a latex to form a homogeneous dispersion, which is coated to form a thermally developable image forming layer. Latex particles are fused to form uniform layer. Further, the polymer preferably has a glass transition point of −20 to 80° C., and more preferably −5 to 60° C. A higher glass transition point raises the thermal developing temperature and a lower glass transition point tends to cause fogging, lowering sensitivity or reducing contrast.

The aqueous dispersible polymer is preferably dispersed in the form of fine particles having a mean size of 1 nm to some micrometers. The aqueous dispersible hydrophobic polymer is called latex and broadly employed as an aqueous coating polymer. Of these, a latex enhancing water resistance is preferred. The latex amount to be used for the purpose of obtaining water resistance depends on its coatability and a larger amount is preferred in terms of moisture resistance. The latex content preferably 50 to 100%, and more preferably 80 to 100%, based on the total binder.

The solid content of binder resin preferably is 0.25 to 10 times silver coverage. In the case of silver coverage of 2.0 $g/m^2$, for example, the polymer coating amount is 0.5 to 20 $g/m^2$. The binder resin content more preferably is 0.5 to 7 times silver coverage. In the case of silver coverage of 2.0

$g/m^2$, for example, the polymer coating amount is 1.0 to 14 $g/m^2$. The binder resin content of less than 0.25 times silver coverage results in deteriorated silver image tone, which is unacceptable in practice. The content of more than 10 times silver coverage results in reduced contrast, which are unacceptable in practice.

In addition to the above-described essential components and binder resin, the image forming layer may optionally contain additives such as an antifoggant, image tone modifier, sensitizing dye, and supersensitizer (or hypersensitizer).

Examples of an antifoggant usable in this invention include compounds described in U.S. Pat. No. 3,874,946 and 4,756,999; heterocyclic compounds containing a substituent represented by the formula of —$C(X_1)(X_2)(X_3)$, in which $X_1$ and $X_2$ are halogen atoms and $X_3$ is a hydrogen atom or a halogen atom); and compounds described in JP-A Nos. 9-288328 and 9-90550, U.S. Pat. No. 5,028,523, European Patent Nos. 600,587, 605,981 and 631,176.

Image tone modifier may be used to modify silver image tone. Examples thereof include imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a,5,6a-tatraazapentalene). Preferred tone modifiers include phthalazone or phthalazine. The image toning agent may be incorporated into a protective layer, without adversely affecting the object of the invention.

As a sensitizing dye is used simple merocyanines described in JP-A No. 60-162247 and 2-48635, U.S. Pat. No. 2,161,331, West German Patent No. 936,071, and Japanese Patent Application No. 3-189532, used for an argon ion laser light source; tri-nuclear cyanines described in JP-A No. 50-62425, 54-18726 and 59-102229 and merocyanines described in Japanese Patent Application No. 6-103272, used for a helium neon laser light source; thiacarbocyanines described in JP=B No. 48-42172, 51-9609 and 55-39818, JP-A No. 62-284343 and 2-105135, used for LED and infrared semiconductor laser light source; tricarbocyanines described in JP-A 59-191032 and 60-80841 and dicarbocyanines having 4-quinoline nuclear described in JP-A No. 59-192242 and in general formulas (III*a*) and (III*b*) of JP-A No. 3-67242, used for infrared semiconductor laser light source. In response to the case where the wavelength of an infrared laser light source is 750 nm or more, and preferably 800 nm or more are preferably used sensitizing dyes described in JP-A No. 4-182639 and 5-341432, JP-B No. 6-52387 and 3-10931, U.S. Pat. No. 5,441,866, and JP-A No. 7-13295.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (M) and disulfide compound which is capable of forming the mercapto compound are preferred as a supersensitizer:

formula (M)

Formula (Ma)

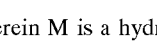

wherein M is a hydrogen atom or an alkali metal atom; Ar is an aromatic ring or condensed aromatic ring containing a nitrogen atom, oxygen atom, sulfur atom, selenium atom or tellurium atom.

The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

The foregoing supersensitizers are incorporated in the image forming layer containing an organic silver salt and silver halide grains, preferably in an amount of 0.001 to 1.0 mol, and more preferably 0.01 to 0.5 mol per mol of silver.

A macrocyclic compound containing a heteroatom may be incorporated in the image forming layer. Thus, macrocyclic compounds comprising a 9-membered or higher member ring (more preferably 12- to 24-membered ring, and still more preferably 15- to 21-membered ring), containing at least one heteroatom selected from nitrogen, oxygen, sulfur and selenium are preferable. Representative compounds thereof include so-called crown ether compounds, which were synthesized for the first time by Pederson in 1967, and many of which were synthesized since then. These compounds are detailed in C. J. Pederson, Journal of American Chemical Society, vol. 86 (2495), 7017–7036 (1967); G. W. Gokel, S. H. Korzeniowski "Maclocyclic Polyether Synthesis", Springer-Vergal, (1982).

In addition to the foregoing additives may be incorporated a surfactant, antioxidant, stabilizer, plasticizer, UV absorber and coating aid. These additives are optionally selected from compounds described in RD Item 17029 (June, 1978, page 9–15).

The image forming layer relating to the invention may be comprised of a single layer or plural layers which are the same or different in composition. The image forming layer usually has a thickness of 10 to 30 μm.

Next, there will be described a support and a protective layer which are essential to the layer constitution of the photothermographic material of the invention.

The support used in the photothermographic material is resin film, such as polyacrylate, polymethacrylate, polyethylene terephthalate, polybutylene terephthalate, polycarbonate, polyarylate, polyvinyl chloride, polyethylene, polypropylene, polystyrene, nylon, aromatic polyamide, polyether ether keton, polysulfon, polyethersulfon, polyimide, polyetherimide, and triacetyl cellulose. The resin film may be comprised of at least two films.

In the image forming method described later, latent images are formed and then thermally developed to form images, so that the support which has been stretched in a film form and thermally set is preferable in terms of dimensional stability.

The protective layer of the photothermographic material is optionally incorporated with a binder optionally selected from the binder resins used in the image forming layer, as described above. A filler is preferably incorporated into the protective layer for the purpose of prevention of abrasion of images and improvement of transportation. The filler is preferably contained in an amount of 0.05 to 30% by weight, based on the composition of the layer. To improve lubrication and antistatic properties, a lubricant and antistatic agent may be incorporated into the protective layer. Examples of the lubricant include a fatty acid, fatty acid ester, fatty acid amide, polyoxyethylene, polyoxypropylene, (modified) silicone oil, (modified) silicone resin, fluorinated resin, fluorocarbon, and wax. Examples of the antistatic agent include cationic surfactants, anionic surfactants, nonionic surfactants, polymeric antistatic agents, metal oxides, conductive polymers, compounds described in "11290 No Kagakushohin (11290 Chemical Goods)" page 875–876, Kagakukogyonippo-sha, and compounds described in U.S. Pat. No. 5,244,773, col. 14–20. Various additives used in the image forming laye may be incorporated into the protective layer, within the range not vitiating effects of the invention. The content thereof preferably is 0.01 to 20%, and more preferably 0.05 to 10% by weight, based on the protective layer forming components. The protective layer may be comprised of a single layer or plural layers which are the same or different in composition. The protective layer thickness is usually 1.0 to 5.0 μm.

In addition to the foregoing image forming layer and protective layer, there may be provided an interlayer to improve adhesion of the image forming layer to the support and a backing layer to improve transportation or antistatic property. The thickness of the interlayer is usually 0.05 to 2.0 μm, and that of the backing layer is usually 1.0 to 5.0 μm.

The respective coating solutions of the foregoing image forming layer and protective layer, and a backing layer optionally provided can be prepared by dissolving or dispersing the constituents described above in a solvent. Solvents having a solubility parameter of 6.0 to 15.0, which is described in "YOZAI POCKET BOOK" (Solvent Pocket Book), edited by the Society of Organic Synthesis Chemistry, Japan, are preferably used in terms of solubility for resins and drying property in the manufacturing process. Solvents for use in the coating solutions to form respective layers include, for example, ketones such as acetone, isophorone, ethyl amyl ketone, methyl ethyl ketone, methyl isobutyl ketone, cyclopentanone, and cyclohexanone; alcohols such as methyl alcohol, ethyl alcohol, n-propyl alcohol, isopropyl alcohol, n-butyl alcohol, isobutyl alcohol, t-butyl alcohol, 2-butyl alcohol, diacetone alcohol, and cyclohexanol; glycols such as ethylene glycol, diethylene glycol, triethylene glycol and propylene glycol; ether alcohols such as ethylene glycol monomethyl ether and diethylene glycol monoethyl ether ethers such as diethyl ether, tetrahydrofurane, 1,3-dioxolan and 1,4-dioxane; esters such as ethylacetate, n-butylacetate, isobutylacetate; hydrocarbons such as n-heptane, cyclohexane toluene and xylene; and chlorides such as methyl chloride, methylene chloride, chloroform and dichlorobenzene. Unless the object of the invention is adversely affected, solvents usable in the invention are not limited to the foregoing solvents.

These solvents are used alone or in combination thereof. A content of the foregoing solvents remaining in the photothermographic material can be adjusted in accordance with the temperature condition in the drying process after completion of the coating process. The residual solvent content in the photothermographic material is preferably 5 to 1000 mg/m $^2$, and more preferably 10 to 300 mg/m$^2$.

In cases when dispersing procedure is needed in the formation of coating solution, commonly known dispersing machines are optimally employed, including a two-roll mill, three-roll mil, ball mill, pebble mil, cobol mill, trone mill, sand mill, sand grinder, Sqegvari atreiter, high-speed impeller dispersant, high-speed stone mill, high-speed impact mill, disperser, high-speed mixer, homogenizer, ultrasonic dispersant, open kneader and continuous kneader.

Commonly known various coater stations are employed to coat coating solutions prepared as above on a support and examples thereof include an extrusion type extruding coater, reverse roll coater, gravure roll coater, air-doctor coater, blade coater, air-knife coater, squeeze coater, dipping coater, bar coater, transfer roll coater, kiss coater, cast coater, and spray coater. Of these coaters, an extrusion type extruding coater a roll coater such as an reverse roll coater are preferable to enhance uniformity in thickness of the layers described above. Coating the protective layer is not specifically limited unless the image forming layer is damaged, and in cases where a solvent used in a coating solution of the protective layer possibly dissolves the image forming layer, the extrusion type extruding coater gravure roll coater and bar coater can be used of the foregoing coater stations. Specifically when a contact coating system, such as a gravure roll coater and bar coater is used, the rotation direction of the gravure roll or bar may be normal or reverse with respect to the transport direction, and in the case of the normal rotation, there may be operated at a constant rate or at rates differing in circumferential speed.

As described above, coating and drying may be repeated for each layer. Alternatively, multi-layer coating may be conducted through a wet-on-wet system, in which the extrusion type extruding coater is used in combination with the foregoing reverse roll coater, gravure roll coater, air doctor coater, blade coater, air-knife coater, squeeze coater, dipping coater, bar coater, transfer roll coater, kiss coater, cast coater, spray coater or slide coater. In such multi-layer coating through a wet-on-wet system, the upper layer is coated on the lower layer in the wet state so that adhesion between the lower and upper layers is enhanced.

After coating the image forming layer coating solution, the coated layer is dried preferably at a temperature of 65 to 100° C. A drying temperature lower than 65° C. results in insufficient completion of reaction, often causing variation in sensitivity after aging, and a drying temperature higher than 100° C. often produces unfavorable fogging (coloring) immediately after the manufacture of the photothermographic material. The drying tome, depending on an air quantity during drying is preferably 2 to 30 min. Drying is carried out at the drying temperature described above immediately after coating. Alternatively, in order to prevent Marangoni effects caused in the coating solution during drying or (orange skin-like) unevenness caused by the surface or its vicinity being initially dried by hot air, drying is initially conducted at a temperature lower than 65° C., followed by drying at the temperature described above.

The object of the invention can be accomplished by the photographic material of the invention and suitable manufacturing methods and optimization of the image forming method results in sharp images having no interference fringe.

Next, image recoding methods suitable for the photothermographic material described above will be described. The image recording method according to the invention is classified into three embodiments according to an angle between lased light and the surface exposed to the light, laser wavelength and number of lasers. These may be conducted alone or in combination thereof, whereby clear images can be obtained without producing any interference fringe.

In one suitable embodiment of the image recording method of the invention, exposure is conducted by the use of laser scanning exposure, in which scanning laser light is not exposed at an angle substantially vertical to the photothermographic material surface exposed to the laser. The expression "laser light is not exposed at an angle substantially vertical to the exposed surface" means that laser light is exposed preferably at an angle of 55 to 88°, more preferably 60 to 86°, and still more preferably 65 to 84°.

In another suitable embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 700 to 1200 nm are preferred in terms of maintenance and the size of the light source.

When the photothermographic material is scanned with laser light using an laser imager or laser image setter, the beam spot diameter on the surface of the photosensitive material is generally within the range of 5 to 75 $\mu$m with respect to minor axis and 5 to 100 $\mu$m with respect to major axis. The laser light scanning speed can be optimally set for respective photothermographic materials in accordance with sensitivity of the photothermographic material at the laser oscillating wavelength and a laser power.

EXAMPLES

The present invention will be further described in detail based on examples, but the invention is by no means limited to these. Amounts shown below are represented by percentage by weight (also denoted as wt %), unless specifically noted.

Preparation of Photothermographic Material

Preparation of Backing Layer Coating Solution

A coating solution to form a backing layer was prepared in the following manner.

To 83 g of methyl ethyl ketone, 8.42 g of cellulose acetate butyrate (CAB381-20, available from Eastman Chemical Co.) and 0.45 g of polyester resin (Biron280, available from Toyobo Co., Ltd.) were added with stirring and dissolved therein. To the resulting solution was added 1.03 g of infrared dye 1. Separately, 0.64 g of fluorinated surfactant [Surflon S-381 (active ingredients of 70%) available from ASAHI Glass Co. Ltd.] and 0.64 g fluorinated surfactant (Megafac F120K, available from DAINIPPON INK Co. Ltd.) were dissolved in 4.32 g methanol, and added to the foregoing solution containing the infrared dye 1. Then, further thereto, 7.5 g of silica (Siloid 64×6000, available from W. R. Grace Corp.), which was dispersed in methyl ethyl ketone in a concentration of 1 wt % using a dissolver type homogenizer, was added to obtain a coating solution for the backing layer.

Coating of Backing Layer

One side of a blue-tinted, 175 $\mu$m thick, biaxially stretched polyethylene terephthalate film, which was tinted so as to have a blue density of 0.170 (which was measured using color transmission densitometer 310T, available from X-Rite Co.) using a blue dye (Ceres Blue RR-J, available from Bayer Co.), was subjected to corona discharge treatment (8 $W/m^2 \cdot min$). The coating solutions was coated on the side that was subjected to the corona discharge treatment, using an extrusion coater and dried so as to form a dry layer of 3.5 $\mu$m.

Preparation of Image Forming Layer Coating Solution

Preparation of Light-Sensitive Silver Halide Emulsion 1

In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous halide solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 12 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain light-sensitive silver halide emulsion 1.

Preparation of Fatty Acid Sodium Salt Solution

In 4720 ml water were dissolved 111.4 g of behenic acid, 83.8 g of arachidic acid and 54.9 g of stearic acid at 80° C. Then, after adding 540.2 ml of 1.5M aqueous sodium hydroxide solution with stirring and further adding 6.9 ml of concentrated nitric acid, the solution was cooled to a temperature of 55° C. to obtain an aqueous fatty acid sodium salt solution.

Preparation of Powdery Organic Silver Salt

To the solution were added the silver halide emulsion 1 obtained above (containing equivalent to 0.038 mol silver)

and stirring further continued for 5 min., while maintained at a temperature of 55° C. Subsequently, 760.6 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 37° C. until no reduction in weight was detected to obtain powdery organic silver salt A.

Preparation of Light-sensitive Emulsified Dispersion

In 14.57 g methyl ethyl ketone was dissolved 14.57 g of poly(vinyl butyral) powder (DENKA Butyral #3000-K, available from Denki Kagaku Kogyo Co., Ltd.) and further thereto was gradually added 500 g of the powdery organic silver salt A with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 0.5 min. of a retention time with a mill to obtain light-sensitive emulsified dispersion.

Preparation of Image Forming Layer Coating Solution

Light-sensitive emulsified dispersion of 50 g and 10.0 g of methyl ethyl ketone were mixed and maintained at 25° C., and 0.320 g of antifoggant 1 methanol solution (11.2%) was added thereto and stirred for 1 hr. Further thereto, 0.425 g of calcium bromide methanol solution (11.2%) was added and stirred for 20 min. Further thereto was added 0.343 g of a solution, in which 0.90 g of dibenzo-18-crown-6 and 0.28 g of potassium acetate were dissolved in 10.0 g of methanol. Subsequently, 4.007 g of the following dye solution 1 was added thereto and stirred for 60 min. and then cooled to a temperature of 13° C. and further stirred for 30 min.

| Dye solution 1 | |
|---|---|
| Infrared sensitizing dye 1 | 0.0103 g |
| 5-methyl-2--mercaptobenzimidazole | 0.244 g |
| 2-chloro-benzoic acid | 0.568 g |
| Benzoic acid derivative 1 | 4.245 g |
| Methyl ethyl ketone | 25.00 g |

To thus prepared solution, 13.29 g of polyvinyl butyral resin (vinyl butyral) powder (DENKA Butyral #3000-K, available from Denki Kagaky Kogyo Co., Ltd.) was added while being maintained at 13° C. and after completely dissolved, 0.152 g of tetrachlorophthalic acid is added and further stirred for 60 min.

To the thus obtained solution, methyl ethyl ketone solution 1 (13.543), solution 2 (5.774 g), solution 3 (4.597 g) and solution 4 (3.785 g) were successively added, as shown in Table 1, with stirring to prepare image forming layer coating solutions Nos. 1 through 24.

| | |
|---|---|
| Solution 1 | |
| Reducing agent (as shown in Table 1) | $1.5 \times 10^{-2}$ mol |
| 4-methylphthalic acid | 0.401 g |
| Infrared dye 1 | 0.0262 g |
| Methyl ethyl ketone | 20.00 g |
| Solution 2 | |
| Trihalomethyl group containing compound 1 | 1.408 g |
| Methyl ethyl ketone | 20.00 g |
| Solution 3 | |
| Phthalazinone | 1.420 g |
| Methyl ethyl ketone | 20.000 g |
| Solution 4 | |
| Silver-saving agent (as shown in Table 1) | $1.5 \times 10^{-4}$ mol |
| Methyl ethyl ketone | 20.00 g |

Preparation of Protective Layer Coating Solution

In 86.5 g of methyl ethyl ketone were dissolved 10.05 g of cellulose acetate butyrate (CAB171-15, available from Eastman Chemical Co.), 0.100 g of benztriazole and 0.10 g fluorinated surfactant (Surflon KH40 available from ASAHI Glass Co. Ltd.). Separately, to 55.0 g of cellulose acetate butyrate solution (CAB171-15, available from Eastman Chemical Co.), which was dissolved in methyl ethyl ketone in 15% solid was added 5 g of silica Silica particles (SYLYSIA 320, available from FUJI SYLYSIA Co.) and the mixture was dispersed using a media dispersing machine filled with zircoania beads to obtain a silica dispersion. The thus obtained silica dispersion of 3.0 g was added to the foregoing resin solution dissolved with benztriazole and dispersed using a ultrasonic homogenizer to obtain a coating solution for a protective layer.

Coating of Image Forming Layer Side

Each of the foregoing image forming layer coating solutions Nos. 1 through 23 and the protective layer coating solution were simultaneously coated on the opposite side to the backing layer of 175 μm thick biaxially stretched PET film, which was previously subjected to corona discharge treatment using an extrusion coater and dried by hot air at 75° C. for 10 min. to obtain photothermographic material samples Nos. 1 through 23. The protective layer thickness was adjusted to 2.35±0.15 μm and the coating solution for the image forming layer was used within 30 after adding the silane coupling agent. The image forming layer and the protective layer were adjusted so as to have dry layer thickness of 21.0±1.5 g/m$^2$ and 2.35±0.15 g/m$^2$. The thus obtained photothermographic material samples No. 1 through 23 shown in Table 1.

TABLE 1

| Sample No. | Image Forming Layer Coating Solution | Reducing Agent (Solution 1) | Silver Saving Agent (Solution 4) | Remark |
|---|---|---|---|---|
| 1 | 1 | Compd. 1 | — | Comp. |
| 2 | 2 | Compd. 1 | Compd. 2 | Comp. |
| 3 | 3 | Compd. 1 | Compd. 3 | Comp. |
| 4 | 4 | Compd. 1 | (1)-1 | Comp. |

TABLE 1-continued

| | | | | |
|---|---|---|---|---|
| 5 | 5 | Compd. 1 | (1)-2 | Comp. |
| 6 | 6 | R-1 | — | Inv. |
| 7 | 7 | R-1 | (1)-1 | Inv. |
| 8 | 8 | R-1 | (1)-2 | Inv. |
| 9 | 9 | R-2 | (1)-1 | Inv. |
| 10 | 10 | R-5 | (1)-5 | Inv. |
| 11 | 11 | R-9 | (1)-1 | Inv. |
| 12 | 12 | R-11 | (1)-5 | Inv. |
| 13 | 13 | R-22 | (1)-10 | Inv. |
| 14 | 14 | R-26 | (1)-1 | Inv. |
| 15 | 15 | R-37 | (1)-22 | Inv. |
| 16 | 16 | R-46 | — | Inv. |
| 17 | 17 | R-46 | (1)-1 | Inv. |
| 18 | 18 | R-46/Compd. 1 | (1)-1 | Inv. |
| 19 | 19 | R-51 | (1)-25 | Inv. |
| 20 | 20 | R-52 | (1)-5 | Inv. |
| 21 | 21 | R-52/Compd. 1 | (1)-30 | Inv. |
| 22 | 22 | R-56 | (1)-1 | Inv. |
| 23 | 23 | R-57 | (1)-5 | Inv. |

Antifoggant 1

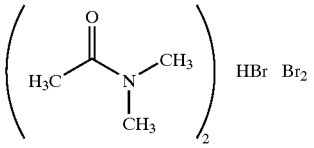

Infrared sensitizing dye 1

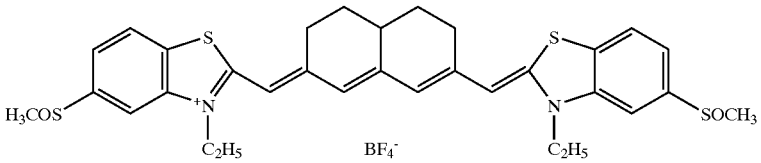

Benzoic acid derivative 1

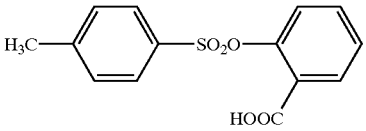

Infrared dye 1

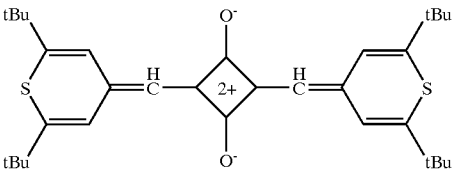

Trihalomethyl group containing compound 1

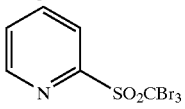

Compd. 2
(JP-A 11-511571)

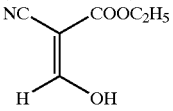

Compd. 1

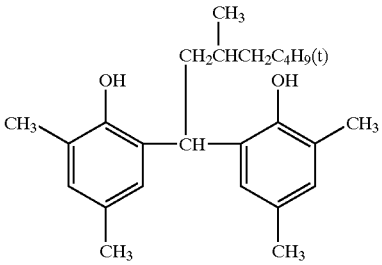

Compd. 3
(JP-A 10-512061)

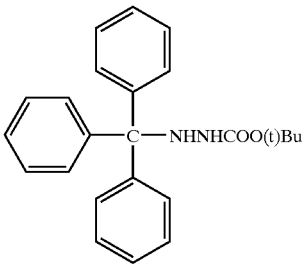

Image Recording and Image Evaluation

Image Recording

Photothermographic material samples Nos. 1, 2, 4, 6, 7, 10, 12, 16 17 and 18 were aged under light-shielding conditions at 23° C. for 120 hrs. (which was designated as aging A) or in an incubator at 50° C. and 55% RH for 120 hrs. (which was designated as aging B), and the thus aged samples were respectively subjected to laser scanning exposure with varying the exposure amount from the emulsion side using an exposure apparatus having a light source of 800 to 820 nm semiconductor laser of a longitudinal multimode, which utilized high frequency overlapping. Subsequently, using an automatic processor incorporating a heated drum, the exposed samples were subjected to thermal development at 122° C. for 16 sec. (Process 1), at 124° C. for 16 sec. (Pprocess 2) or at 122° C. for 18 sec (Process 3), while bringing the protective layer surface of the photothermographic material into contact with the drum surface. Thus, thermally developed photothermographic material samples were obtained. Laser scanning exposure was conducted at an angle of 75 degrees between the exposed surface and exposing laser light and at laser spot in an ellipse form of diameters of 100 μm in the main scanning direction and 75 μm in the sub-scanning direction, while the laser scanning pitch was 100 μm in the main scanning direction and 75 μm in the sub-scanning direction. There was employed an automatic thermal processor, which was provided with a heating drum having a layered rubber surface exhibiting a center-line means surface roughness (Ra) of 1.0 μm, surface roughness Sm (a mean spacing between protrusioins) and a surface rubber hardness of 60, as defined in JIS K6253 Type A.

The thus exposed and thermally developed samples were evaluated according to the following procedure. Results thereof are shown in Table 2.

Sensitivity

Using a densitometer (color transmission densitometer 310T, available from X-Rite Co.), densitometry was conducted with respect to visual transmission density. Sensitivity was defined as the reciprocal of the exposure amount necessary to give a density of 1.0 above an unexposed area, and represented by a relative value, based on the sensitivity of photothermographic material sample No. 1, which was aged at aging A and processed according to the process 1 being 100. The exposure amount giving a density of 1.0 above an unexposed area was measured at three or more points within the density region of +0.7 to +1.2 above an unexposed area and determined by linear regression.

Fog Density

Visual transmission density was measured at five points in unexposed areas using a densitometer (color transmission densitometer 310T, available from X-Rite Co.) and an averaged value thereof was defined as the fog density (denoted as Dmin).

Maximum Density (Dmax)

Visual transmission densities were measured at three points in the maximum exposed area using a densitometer (color transmission densitometer 310T, available from X-Rite Co.) and an averaged value thereof was defined as the maximum density (Dmax). The maximum density was represented by a relative value, based on the maximum density of photothermographic material sample No. 1, which was aged at aging A and processed according to the process 1 being 100.

Silver Image Tone

Samples were visually observed with respect to a portion having a transmission density of 1.1±0.05 and silver image tone was evaluated based on the following criteria, in which a ranking of 4 or more was an acceptable level for practical use:

5: a blue black tone was exhibited, while no yellowish tone was noted,

4: a blue black tone was not exhibited but neither a yellowish tone was noted,

3: a partial yellowish tone was noted,

2: a slightly yellowish tone was overall noted,

1: a yellowish tone was apparent.

TABLE 2

| Sample No. | Aging | Process | Sensitivity | Fog | Dmax | Silver Image Tone | Remark |
|---|---|---|---|---|---|---|---|
| 1 | A | 1 | 100 | 0.10 | 100 | 3 | Comp. |
| 1 | A | 2 | 110 | 0.20 | 133 | 3 | Comp. |
| 1 | A | 3 | 90 | 0.15 | 125 | 3 | Comp. |
| 1 | B | 1 | 85 | 0.08 | 90 | 2 | Comp. |
| 1 | B | 2 | 88 | 0.25 | 85 | 2 | Comp. |
| 1 | B | 3 | 83 | 0.27 | 85 | 2 | Comp. |
| 2 | A | 1 | 130 | 0.60 | 160 | 2 | Comp. |
| 2 | A | 2 | 145 | 0.70 | 180 | 2 | Comp. |
| 2 | A | 3 | 125 | 0.65 | 155 | 2 | Comp. |
| 2 | B | 1 | 78 | 0.90 | 120 | 1 | Comp. |
| 2 | B | 2 | 85 | 0.99 | 125 | 1 | Comp. |
| 2 | B | 3 | 92 | 0.85 | 110 | 1 | Comp. |
| 4 | A | 1 | 150 | 0.45 | 160 | 3 | Comp. |
| 4 | A | 2 | 160 | 0.55 | 150 | 3 | Comp. |
| 4 | A | 3 | 155 | 0.45 | 140 | 3 | Comp. |
| 4 | B | 1 | 120 | 0.55 | 122 | 2 | Comp. |
| 4 | B | 2 | 130 | 0.55 | 123 | 2 | Comp. |
| 4 | B | 3 | 110 | 0.45 | 124 | 2 | Comp. |
| 6 | A | 1 | 160 | 0.05 | 172 | 4 | Inv. |
| 6 | A | 2 | 160 | 0.05 | 170 | 4 | Inv. |
| 6 | A | 3 | 160 | 0.05 | 170 | 4 | Inv. |
| 6 | B | 1 | 165 | 0.06 | 170 | 4 | Inv. |
| 6 | B | 2 | 165 | 0.06 | 170 | 4 | Inv. |
| 6 | B | 3 | 164 | 0.06 | 170 | 4 | Inv. |
| 7 | A | 1 | 180 | 0.04 | 180 | 5 | Inv. |
| 7 | A | 2 | 180 | 0.04 | 181 | 5 | Inv. |
| 7 | A | 3 | 181 | 0.04 | 180 | 5 | Inv. |
| 7 | B | 1 | 179 | 0.04 | 179 | 5 | Inv. |
| 7 | B | 2 | 175 | 0.04 | 179 | 5 | Inv. |
| 7 | B | 3 | 176 | 0.04 | 175 | 5 | Inv. |

TABLE 3

| Sample No. | Aging | Process | Sensitivity | Fog | Dmax | Silver Image Tone | Remark |
|---|---|---|---|---|---|---|---|
| 10 | A | 1 | 175 | 0.03 | 170 | 4 | Inv. |
| 10 | A | 2 | 175 | 0.04 | 171 | 4 | Inv. |
| 10 | A | 3 | 174 | 0.03 | 172 | 5 | Inv. |
| 10 | B | 1 | 170 | 0.03 | 170 | 4 | Inv. |
| 10 | B | 2 | 170 | 0.03 | 170 | 5 | Inv. |
| 10 | B | 3 | 170 | 0.03 | 165 | 4 | Inv. |
| 12 | A | 1 | 165 | 0.05 | 160 | 4 | Inv. |
| 12 | A | 2 | 165 | 0.04 | 160 | 4 | Inv. |
| 12 | A | 3 | 164 | 0.05 | 158 | 5 | Inv. |
| 12 | B | 1 | 160 | 0.03 | 155 | 5 | Inv. |
| 12 | B | 2 | 160 | 0.03 | 155 | 4 | Inv. |
| 12 | B | 3 | 165 | 0.03 | 155 | 5 | Inv. |
| 16 | A | 1 | 188 | 0.03 | 188 | 5 | Inv. |
| 16 | A | 2 | 187 | 0.03 | 188 | 5 | Inv. |
| 16 | A | 3 | 188 | 0.03 | 188 | 5 | Inv. |
| 16 | B | 1 | 180 | 0.04 | 180 | 5 | Inv. |
| 16 | B | 2 | 180 | 0.04 | 180 | 5 | Inv. |
| 16 | B | 3 | 180 | 0.04 | 180 | 5 | Inv. |
| 17 | A | 1 | 200 | 0.02 | 195 | 5 | Inv. |
| 17 | A | 2 | 201 | 0.02 | 195 | 5 | Inv. |
| 17 | A | 3 | 200 | 0.03 | 195 | 5 | Inv. |
| 17 | B | 1 | 198 | 0.02 | 196 | 5 | Inv. |
| 17 | B | 2 | 198 | 0.02 | 196 | 5 | Inv. |
| 17 | B | 3 | 198 | 0.03 | 196 | 5 | Inv. |
| 18 | A | 1 | 195 | 0.05 | 190 | 4 | Inv. |
| 18 | A | 2 | 195 | 0.04 | 190 | 5 | Inv. |
| 18 | A | 3 | 195 | 0.04 | 190 | 5 | Inv. |
| 18 | B | 1 | 190 | 0.04 | 188 | 4 | Inv. |
| 18 | B | 2 | 190 | 0.04 | 188 | 5 | Inv. |
| 18 | B | 3 | 191 | 0.04 | 188 | 4 | Inv. |

As is apparent from tables 2 and 3, it was proved that the inventive samples exhibited improved raw stock stability such as reduced lowering of sensitivity and maximum density, little increase of fogging and superior silver image tone even when aged under environments of high temperature and high humidity, as compared to the comparative samples. Further, it was also proved that stable characteristics were achieved even when processing conditions such as developing temperature or time varied.

Similar evaluation of samples other than the foregoing ones also resulted in superior raw stock stability, silver image tone and process stability.

What is claimed is:

1. A photothermographic material comprising on a support an organic silver salt, light-sensitive silver halide and a reducing agent for silver ions, wherein the reducing agent is represented by the following formula (1):

formula (1)

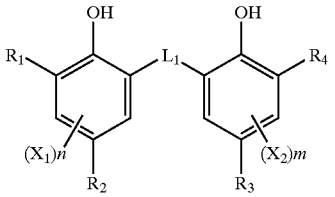

wherein $R_1$ through $R_4$ are each independently an alkyl group, provided that at least one of $R_1$ through $R_4$ is an alkyl group containing a hydroxy group or a group capable of forming a hydroxy group upon deprotection; $L_1$ is —S— or —$CR_{55}(R_{66})$—, in which $R_{55}$ and $R_{66}$ are each a hydrogen atom, an alkyl group, a 3- to 10-membered non-aromatic ring group, an aryl group or a heteroaryl group; $X_1$ and $X_2$ are each a group capable of being substituted on a benzene ring; and n and m are each an integer of 0 to 2.

2. The photothermographic material as claimed in claim 1, wherein at least one of $R_1$ through $R_4$ is an alkyl group containing a hydroxy group.

3. The photothermographic material as claimed in claim 1, wherein $R_2$ and $R_3$ are each an alkyl group containing a hydroxy group or a group capable of forming a hydroxy group upon deprotection.

4. The photothermographic material as claimed in claim 3, wherein $R_2$ and $R_3$ are each an alkyl group containing a hydroxy group.

5. The photothermographic material as claimed in claim 3, wherein $R_1$ and $R_4$ are each a secondary or tertiary alkyl group.

6. The photothermographic material as claimed in claim 1, wherein $L_1$ is —$CR_{55}$ $(R_{66})$—.

7. The photothermographic material as claimed in claim 6, wherein $R_{55}$ is a 5- or 6-membered non-aromatic ring group and $R_{66}$ is a hydrogen atom.

8. The photothermographic material as claimed in claim 1, wherein the reducing agent represented by formula (1) is represented by the following formula (2):

formula (2)

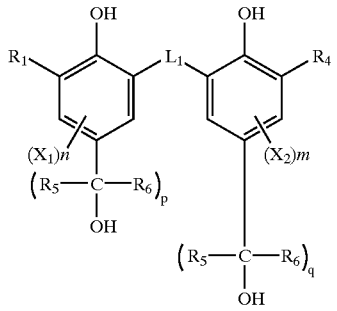

wherein $R_1$, $R_4$, $L_1$, $X_1$, $X_2$, n and m are each the same as defined in formula (1); $R_5$ and $R_6$ are a hydrogen atom or an alkyl group; p and q are each an integer of 0 to 5.

9. The photothermographic material as claimed in claim 8, wherein in formula (2), $R_5$ and $R_6$ are a hydrogen atom; and p and q are each 2.

10. The photothermographic material as claimed in claim 8, wherein $R_1$ and $R_4$ are each a secondary or tertiary alkyl group.

11. The photothermographic material as claimed in claim 8, wherein in formulas (2), $R_{55}$ is a 5- or 6-membered non-aromatic ring group and $R_{66}$ is a hydrogen atom.

12. The photothermographic material as claimed in claim 1, wherein the photothermographic material comprises a silver-saving agent.

13. The photothermographic material as claimed in claim 12, wherein the silver-saving agent is represented by the following formula (X):

formula (X)

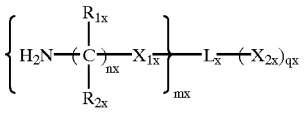

wherein $R_{1x}$ and $R_{2x}$ are each a hydrogen atom or a substituent; $X_{1x}$ is —S—, —O— or —$N(R_{3x})$—, in which $R_{3x}$ is a hydrogen atom or substituent; nx is 2 or 3; mx is an integer of 1 to 3; $X_{2x}$ is a ballast group, an adsorption group onto silver halide or a silyl group; qx is an integer of 1 to 3; and $L_x$ is a di- to hexa-valent linkage group.

* * * * *